US006549092B1

(12) United States Patent
Hattori et al.

(10) Patent No.: US 6,549,092 B1
(45) Date of Patent: Apr. 15, 2003

(54) RESONATOR DEVICE, FILTER, COMPOSITE FILTER DEVICE, DUPLEXER, AND COMMUNICATION DEVICE

(75) Inventors: Jun Hattori, Takatsuki (JP); Hiroki Wakamatsu, Kyoto (JP); Hiroyuki Kubo, Kusatsu (JP); Kenji Saito, Nishinomiya (JP)

(73) Assignee: Murata Manufacturing Co. Ltd. (JP)

( * ) Notice: Subject to any disclaimer, the term of this patent is extended or adjusted under 35 U.S.C. 154(b) by 0 days.

(21) Appl. No.: 09/679,176

(22) Filed: Oct. 4, 2000

(30) Foreign Application Priority Data

Oct. 4, 1999 (JP) ..... 11-283037
Jun. 2, 2000 (JP) ..... 2000-165335

(51) Int. Cl.[7] ..... H01P 1/213; H01P 1/20; H01P 1/202; H01P 7/10

(52) U.S. Cl. ..... 333/134; 333/206; 333/202; 333/219.1

(58) Field of Search ..... 333/134, 202, 333/203, 206, 219, 219.1, 222

(56) References Cited

U.S. PATENT DOCUMENTS 4,138,652 A * 2/1979 Nishikawa et al. ..... 333/202 X
4,626,809 A * 12/1986 Mizumura et al. ..... 333/202
4,724,403 A * 2/1988 Takayama ..... 331/96

FOREIGN PATENT DOCUMENTS

DE 4018219 A1 12/1991
JP 60-107902 6/1985

OTHER PUBLICATIONS

European Search Report dated Feb. 21, 2002.

Dick G.J. et al., "Temperature Compensated Sapphire Resonator For Ultra–Stable Oscillator Capability At Temperatures Above 77 Kelvin", Proceedings of the International Frequency Control Symposium, Boston, Jun. 1–3, 1994, New York, IEEE, vol. SYMP. 48, Jun. 1, 1994, pp. 421–432, XP000625537.

Hwang, H. et al., "The Design Of Band–Pass Filters Made Of Both Dielectric And Coaxial Resonators", 1997 IEEE MTT–S International Microwave Symposium Digest, New York, NY, IEEE, US, vol. 2, Jun. 8, 1997, pp. 805–808, XP000767630.

* cited by examiner

*Primary Examiner*—Benny Lee
*Assistant Examiner*—Stephen E. Jones
(74) *Attorney, Agent, or Firm*—Dickstein, Shapiro, Morin & Oshinsky, LLP

(57) ABSTRACT

In a cavity body, a conductor rod is provided with least one end thereof being electrically connected to the cavity. A dielectric core is disposed in the cavity and the conductor rod extends through a hole in the dielectric core. With this structure, the cavity and the conductor rod constitute a resonator which operates in the quasi-TEM mode of a re-entrant cylindrical cavity resonator. The cavity and the dielectric core constitute a resonator which operates in the quasi-TM mode.

20 Claims, 28 Drawing Sheets

RESONATOR DEVICE, FILTER, COMPOSITE FILTER DEVICE, DUPLEXER, AND COMMUNICATION DEVICE

BACKGROUND OF THE INVENTION

1. Field of the Invention

The present invention relates to a resonator device in which plural resonance modes are multiplexed, a method of producing the same, a filter, a composite filter device, a duplexer, and a communication device including the foregoing devices.

2. Description of the Related Art

Conventionally, cavity resonators and re-entrant cylindrical cavity resonators. (re-entrant resonators) have been used for operation at relatively high power in the microwave range. The re-entrant cylindrical cavity resonator is also called a coaxial cavity resonator. Its Q value is relatively high, and its size is smaller than that of a cavity resonator. Therefore, the use of re-entrant cylindrical cavity resonators has been effective in reducing the size of microwave filters.

On the other hand, with microcells being employed in cellular mobile communication systems, e.g., in mobile telephones and so forth, the need is growing to further reduce the size of filters for use in base stations.

To form a multistage resonator comprising a plurality of re-entrant cylindrical cavity resonators requires a number of resonators equal to the number of stages to be formed. Thus, there has been the problem that the overall size of the filter becomes large.

SUMMARY OF THE INVENTION

Accordingly, the present invention addresses this problem by providing a resonator device in which the structure of a re-entrant cylindrical cavity resonator or coaxial resonator is partially adopted, which can be configured in a small size, even when the number of resonator stages is increased.

The invention further provides a filter, a composite filter device, a duplexer, and a communication device using such a resonator.

To provide the above features, the resonator device in accordance with the present invention comprises a conductive rod provided in a conductive cavity with at least one end of the rod being electrically connected to the cavity, and a dielectric core provided in the cavity.

The mode of a re-entrant cylindrical cavity resonator is determined by the cavity and the conductor rod. A resonance mode such as a TM mode is determined by the cavity and the dielectric core. A resonance mode such as a TE mode is determined by the dielectric core. These resonance modes caused by use of the dielectric core and the mode of the above-mentioned re-entrant cylindrical cavity resonator are coupled to each other.

With this structure, resonators can be multiplexed in one cavity. By forming a single resonator device having a plurality of stages, the size of the device can be reduced.

Preferably, a hole is formed in the dielectric core, and the rod is inserted in and through the hole. With this structure, the dielectric core can be disposed in an optional position, e.g., in the center of the cavity.

The dielectric core may be bonded to the inner surface of the cavity. With this structure, the capacitance component which determines the resonance frequency in the resonance mode caused by the cavity and the dielectric core can be increased.

Preferably, the dielectric core is supported on a stand in the cavity, and the dielectric core is spaced from the inner surface of the cavity. With this structure, the capacitance component which determines the resonance frequency in the resonance mode caused by the dielectric core can be decreased.

Also preferably, the resonance modes caused by the cavity and the dielectric core provide a duplex TM mode, which is then coupled to the mode of the re-entrant cylindrical cavity resonator so as to provide a triplex mode.

A method of producing a resonator according to the present invention comprises the steps of selecting a material for the dielectric core such that the change of the resonance frequency in the resonance mode caused by the cavity and the dielectric core can be made substantially constant for changes in temperature, and selecting a material for the rod such that the change of the resonance frequency in the resonance mode caused by the cavity and the rod can be made substantially constant for changes in temperature.

In the filter of the present invention, an input-output conductor is provided in the resonator device having the above-described structure to be coupled to a predetermined mode of the above resonance modes in order to carry out input-output of a signal.

The composite filter device of the present invention comprises a plurality of the above-described filters.

The duplexer of the present invention comprises two sets of the filters, in which the input port of the first filter is an input port for a transmission signal, the output port of the second filter is an output port for a reception signal, and the input-output port shared by the first and second filters is an antenna port.

The communication device of the present invention is formed by use of the filter, the composite filter device, or the duplexer.

Other features and advantages of the present invention will become apparent from the following description of the invention which refers to the accompanying drawings, wherein like references indicate like elements and parts.

DESCRIPTION OF EMBODIMENTS OF THE INVENTION

The configuration of a resonator device according to a first embodiment of the present invention will be described with reference to FIGS. 1 to 4.

Figure 1:
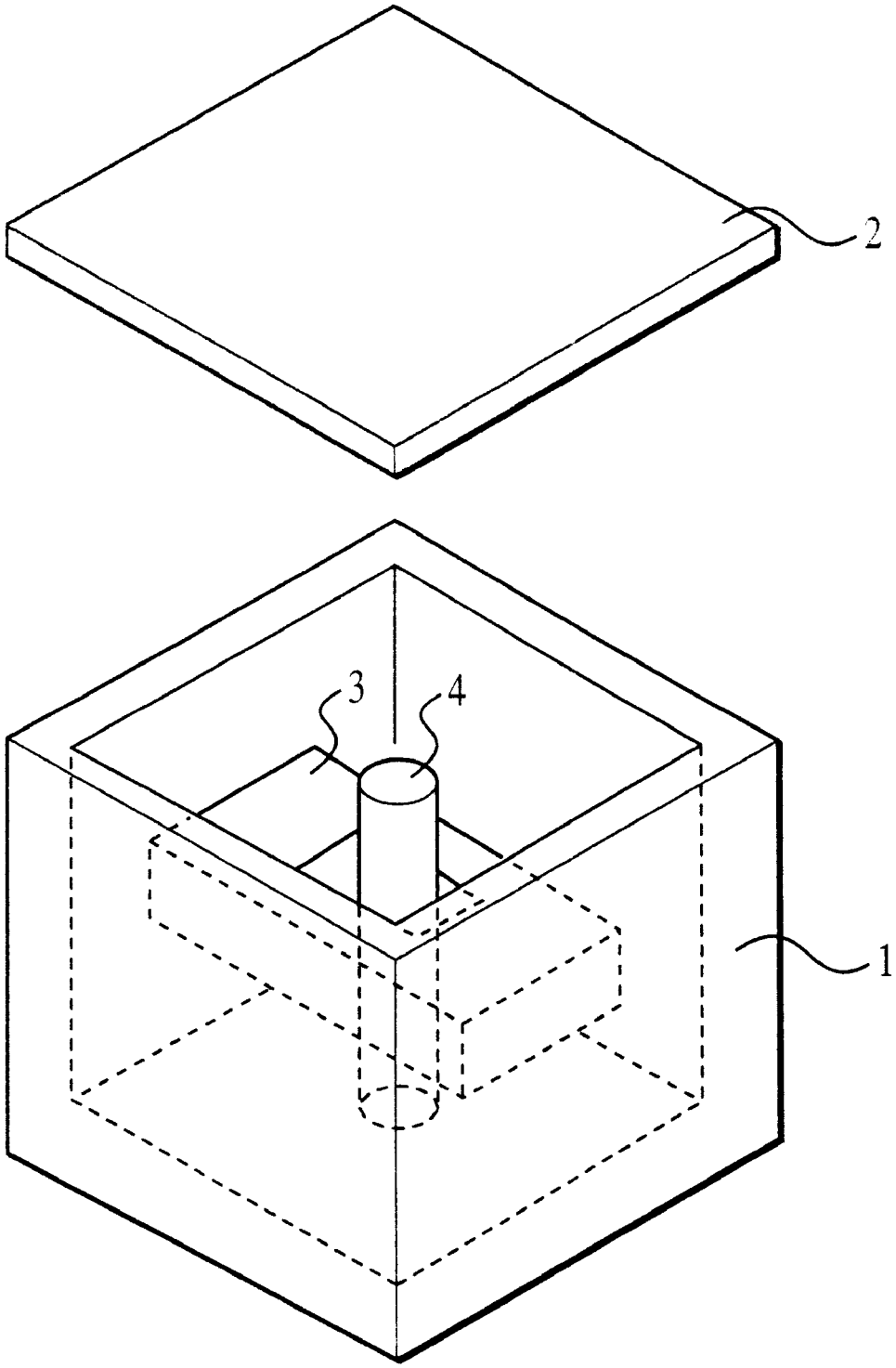
FIG. 1 is an exploded perspective view of a resonator device according to a first embodiment of the present invention.

FIG. 1 is an exploded perspective view of the resonator device. In FIG. 1, the resonator device contains a cavity body 1 having a substantially rectangular parallelepiped shape of which the upper side is open, and the underside is closed, and a cavity lid 2 covering the open upper side of the cavity body 1. A conductor rod 4 is formed so as to protrude from the center of the inner bottom of the cavity body 1, extending in parallel to the respective inner walls of the cavity body 1. Moreover, as shown in FIG. 1, a dielectric core 3 having a substantially rectangular parallelepiped shape is provided, which has a hole which the conductor rod 4 is inserted in and through.

Figure 2A:
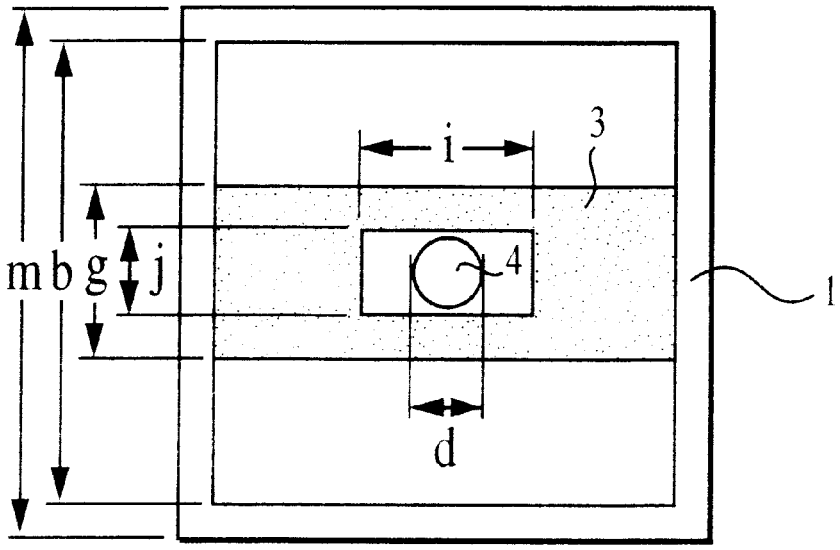
FIGS. 2A and 2B are a plan view and a cross section of the resonator device.
Figure 2B:
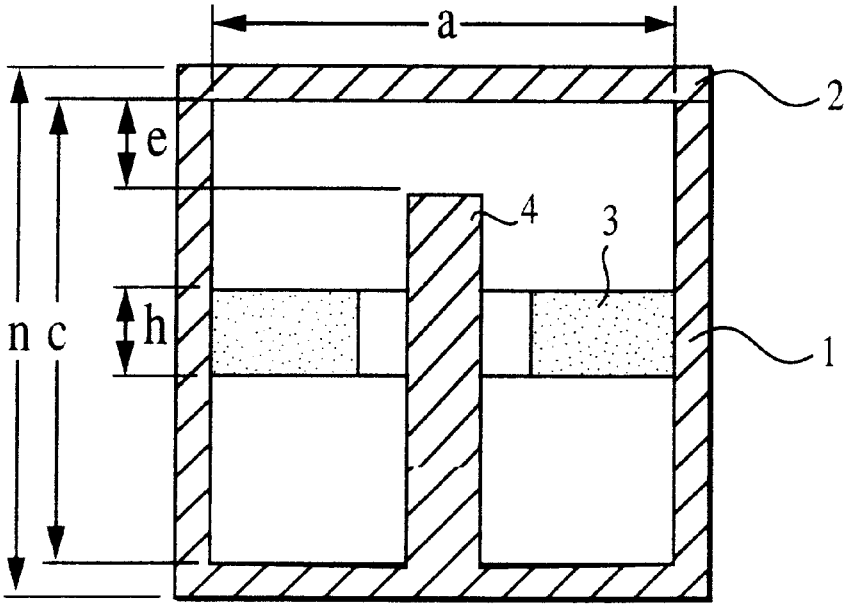

FIG. 2A is a plan view of the resonator device before the cavity lid 2 is attached. FIG. 2B is a central, longitudinal cross section of the resonator device having the cavity lid 2 attached thereto. The conductor rod 4 is formed integrally with the cavity body 1, and has such a length that a predetermined gap is produced between the top of the conductor rod 4 and the inner surface of the cavity lid 2. Both of the end-faces in the longitudinal direction of the dielectric core 3 are bonded to the inner walls of the cavity body 1, respectively. For example, Ag electrodes are formed by metallization on both of the end-faces of the dielectric core 3, and are bonded by soldering to the inner walls of the cavity body 1, respectively. The cavity body 1 and the cavity lid 2 are formed by casting or cutting a metallic material, or for the formation, a conductor film is applied on a ceramic or resin.

The conductor rod 4 may be formed separately from the cavity body 1 and fixed to the cavity body 1 by screwing, soldering, or the like. The conductor rod 4 may be provided, separately from the cavity lid 2 or integrally with the cavity lid 2. Also, the conductor rod 4 may be formed by casting or cutting a metallic material, or for the formation, a conductor film may be applied on the surface of a ceramic or resin, similarly to the cavity body 1 and the cavity lid 2.

Figure 3A:
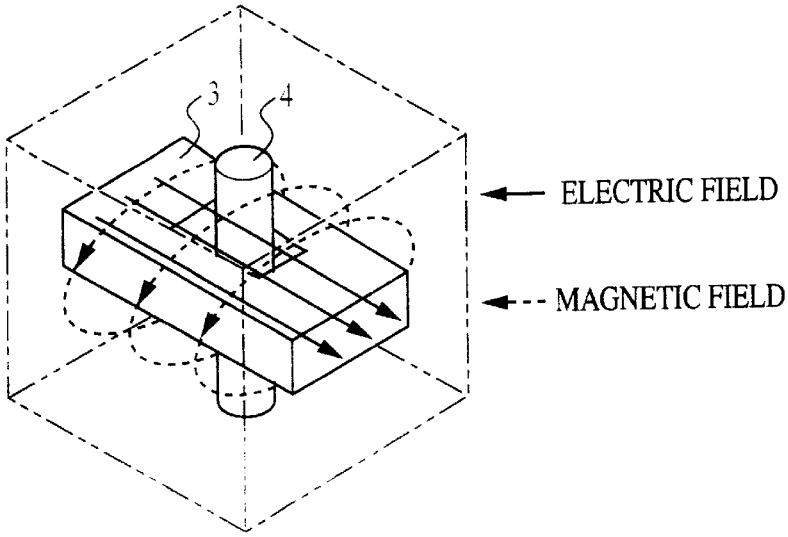
FIGS. 3A, 3B, and 3C show examples of the electromagnetic field distributions in the respective resonance modes of the resonator device.
Figure 3B:
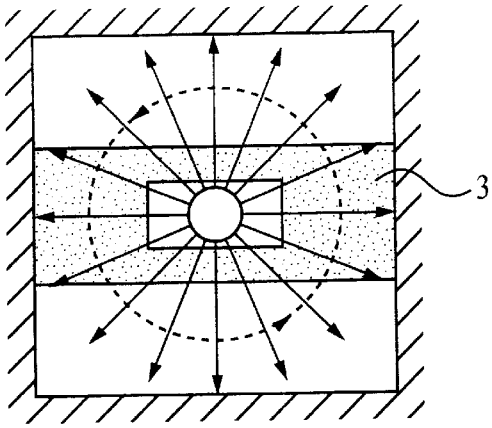
Figure 3C:
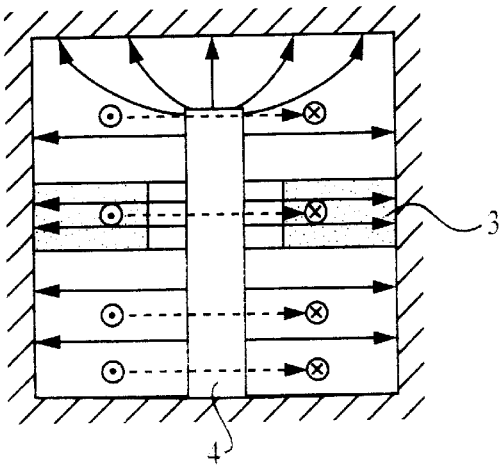

FIGS. 3A, 3B, and 3C show examples of the electromagnetic field distributions in the respective modes of the resonator device. In these figures, the solid line arrows indicate electric field vectors, while the broken line arrows indicate magnetic field vectors. FIG. 3A illustrates an electromagnetic field distribution in the TM mode, caused by the dielectric core 3 and the cavity. In this mode, the electric field vector is directed in the longitudinal direction of the dielectric core 3. The magnetic vector draws a loop in a plane perpendicular to the longitudinal direction of the dielectric core 3. Here, though the dielectric core 3 has a rectangular parallelepiped shape, a circular cylindrical coordinates system is employed as the representation of a mode. The numbers of waves in the respective electric field intensity distributions are represented by the sequence TMθrh, in which h represents the number of waves in the propagation direction, θ represents the number of waves in the in-plane turning direction in a plane perpendicular to the propagation direction, and r represents the number of waves in the in-plane radiation (radial) direction in a plane perpendicular to the propagation direction. Accordingly, this mode is referred to as the TM010 mode. In this embodiment, the dielectric core 3 is not cylindrical (it is not circular in cross-section), and the conductor rod 4 is disposed in the center of the dielectric core 3. Therefore, practically, this mode is similar to the TM010 mode, and hereinafter, is referred to as a "quasi-TM mode".

FIGS. 3B and 3C are a plan view and a front view of the re-entrant cylindrical cavity resonator in a mode caused by the cavity and the conductor rod 4. In this mode, the electric field vector is directed in the radial direction from the conductor rod 4 to the inner walls of the cavity. The magnetic field vector forms a loop turning-around with respect to the conductor rod 4. Unlike the ordinary re-entrant cylindrical cavity resonator, the dielectric core 3 is charged, and the top of the conductor rod 4 and the top-plane of the cavity have a gap therebetween. Thus, this mode is named a quasi-TEM mode.

In one example, the sizes of the respective parts of the resonator shown in FIGS. 2A–2B are as follows:

a=37 mm, b=37 mm, c=37 mm, d=5 mm, e=12 mm, g=13.5 mm, h=6 mm, i=15 mm, j=7 mm, m=42 mm, n=39.5 mm

If the dielectric constant of the dielectric core 3 is set at 37, the resonance frequency in the quasi-TM mode is 1910 MHZ, and that in the quasi-TEM mode is 2155 MHZ. Thus, this device can be used as a 2 GHz band resonator.

The quasi-TM mode and the quasi-TEM mode shown in FIGS. 3A, 3B, and 3C are not coupled together, since the electric field intensities in the longitudinal direction of the dielectric core 3 are balanced with each other. However, by unbalancing the electric field intensities in these two modes, the modes can be coupled together.

Figure 4:
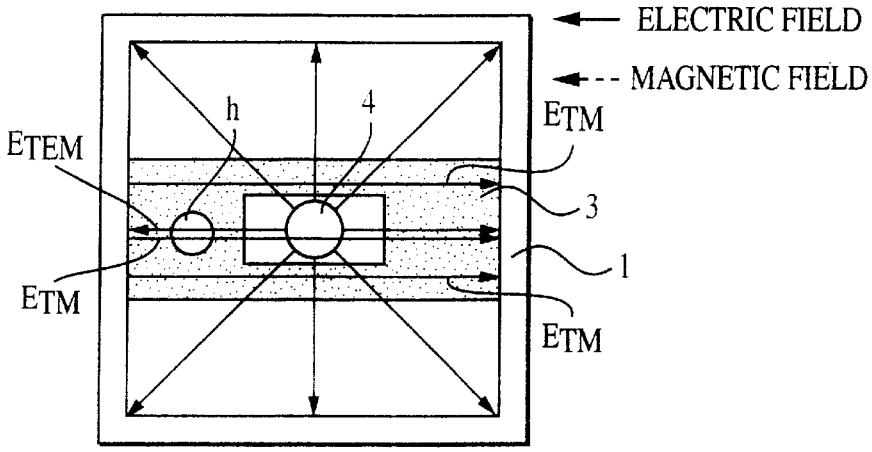
FIG. 4 illustrates coupling of the two resonance modes in the resonator device.

FIG. 4 illustrates an example of the structure by which the above-mentioned two modes can be coupled together. FIG. 4 is a plan view of the resonator device prior to the attachment of the cavity lid 2. The electric field vector $E_{TEM}$ in the quasi-TEM mode is directed in the radial direction from the conductor rod 4, and the electric field vector $E_{TM}$ in the quasi-TM mode is directed in the longitudinal direction of the dielectric core 3. Accordingly, the two modes are coupled to each other by making the electric field intensity in the range between one end in the longitudinal direction of the dielectric core 3 and the center thereof (the conductor rod 4 portion) unbalanced with respect to that in the range between the other end and the center. In particular, as shown in FIG. 4, a coupling adjustment hole h is provided, so that the symmetry of the electric field intensity is lost in the vicinity of the hole h, and thereby, the quasi-TEM mode and the quasi-TM mode are coupled together. The coupling degree is determined by the size (inner diameter or depth) of the coupling adjustment hole h.

In the first embodiment, a gap is provided between the hole in the center of the dielectric core 3 and the conductor rod 4. This suppresses the conductor loss which will be caused, by current flowing in the conductor rod 4, and enhances the Q value of the resonator. However, the above-mentioned gap is not essential. The wall of the hole in the center of the dielectric core 3 may be bonded to the conductor rod 4.

Figure 5A:
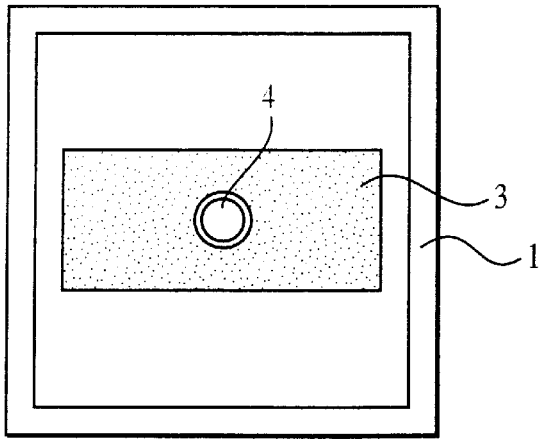
FIGS. 5A and 5B are cross sections of a resonator device according to a second embodiment of the present invention.
Figure 5B:
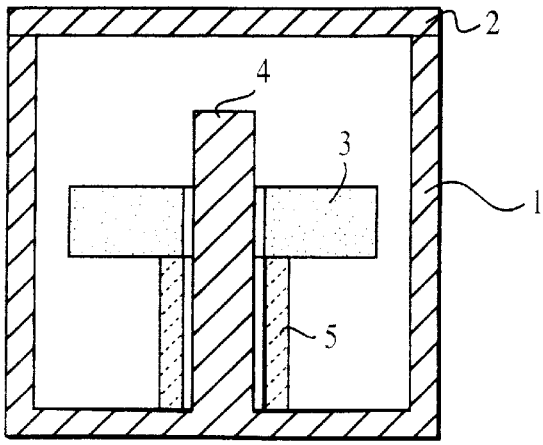

FIGS. 5A and 5B show the structure of a resonator device according to a second embodiment of the present invention. FIG. 5A is a plan view of the resonator device before the cavity lid 2 is attached. FIG. 5B is a longitudinal cross section of the resonator device. In the second embodiment, the end-faces of the dielectric core 3 are spaced from the inner walls of the cavity, which is different from the first embodiment. As shown in FIG. 5B, a stand 5 for supporting the dielectric core 3 is provided. The stand 5 is made of a ceramic material having a low dielectric constant, is formed into a cylindrical shape, and is bonded to the dielectric core 3. The conductor rod 4 is inserted in and through the dielectric core 3 having the stand 5 attached thereto, whereby the dielectric core 3 is fixed substantially in the center of the cavity.

In the case in which a gap is provided between the end-faces in the longitudinal direction of the dielectric core 3 and the inner walls of the cavity, as described above, a change in the electric field intensity is generated in the above-mentioned propagation direction h in the sequence TMθrh. Accordingly, this resonance mode can be expressed as the TM01δ mode. "δ" is a figure less than 1, that is, it indicates that a wave is not completely propagated in the above-mentioned propagation direction, and a change in the intensity is generated.

According to this structure, static capacitance is produced in the gap between the end-faces of the dielectric core 3 and the inner walls of the cavity. Thus, the static capacitance between the inner walls of the cavity opposed to the end-faces in the longitudinal direction of the dielectric core 3, respectively, is reduced. Therefore, though the size (the distance between the inner walls opposed to the end-faces) of the cavity suitable to obtain the required resonance frequency in the quasi-TM mode becomes large, the density of current flowing in the cavity is decreased. Thus, the Q value of the resonator can be enhanced.

Figure 6A:
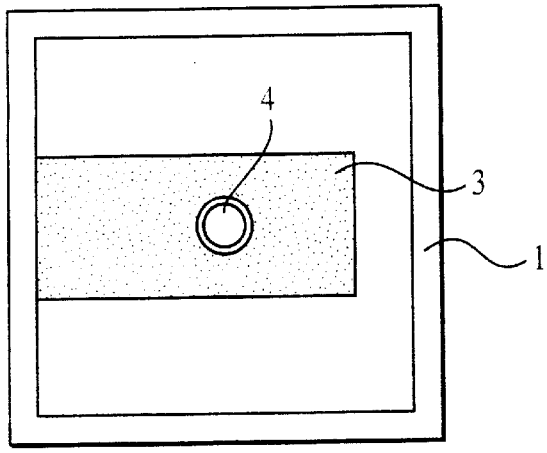
FIGS. 6A and 6B are a plan view and a cross section of a resonator device according to a third embodiment of the present invention.
Figure 6B:
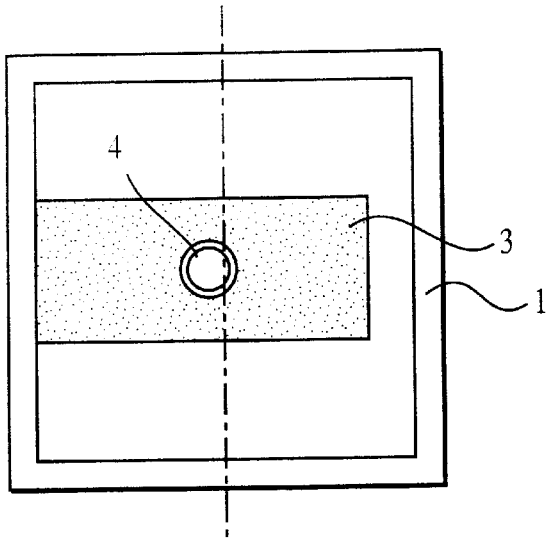

FIGS. 6A and 6B show two examples of the configuration of a resonator according to a third embodiment of the present invention. These figures are plan views of the resonator device before the cavity lid is attached thereto. In each example, one end-face in the longitudinal direction of the dielectric core 3 is bonded to the inner wall of the cavity body 1, while the other end is spaced from the inner wall of the cavity. In such a structure, the resonator device has a characteristic which is intermediate between the characteristic of the resonator device having both of the ends in the longitudinal direction of the dielectric core 3 bonded to the inner walls of the cavity, and the characteristic of the resonator device having both of the ends of the dielectric core spaced from the inner walls of the cavity. Accordingly, a resonator having a small overall size and a high Q value can be obtained.

In FIG. 6A, the conductor rod 4 is disposed on the center axis of the cavity. As shown in FIG. 6B, the conductor rod 4 may be inserted in and through the center portion of the dielectric core 3, so that the conductor rod 4 is in a position disposed away from the center axis of the cavity. In the present invention, the cavity and the conductor rod 4 are not necessarily coaxial. Even if the axes of the cavity and the conductor rod 4 are different from each other, the resonator device of the present invention functions as a so-called re-entrant cylindrical cavity resonator.

Figure 7:
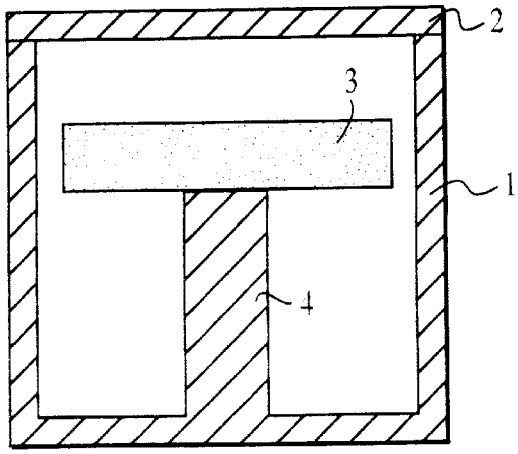
FIG. 7 is a cross section of a resonator device according to a fourth embodiment of the present invention.

FIG. 7 is a longitudinal cross section of a resonator device according to a fourth embodiment of the present invention. In the first to the third embodiments, the conductor rod 4 is inserted in and through the hole formed in the dielectric core 3. The dielectric core 3 may be disposed between the top of the conductor rod 4 and the inner surface of the cavity opposed to the top of the conductor rod 4 (in this example, the underside of the cavity lid 3), as shown in FIG. 7. With this structure, the dielectric core 3 can be easily molded. If the dielectric core 3 is bonded to the top of the conductor rod 4 as in the embodiment of FIG. 7, the dielectric core 3 can be fixed without a stand being provided.

Figure 8:
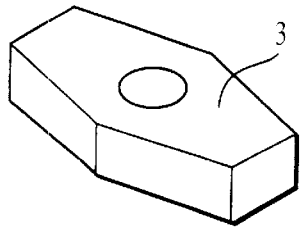
FIG. 8 is a perspective view of a dielectric core for use in a resonator device according to a fifth embodiment.

FIG. 8 is a perspective view showing the structure of the dielectric core 3 of a resonator device according to a fifth embodiment of the present invention. The shape of the dielectric core 3, together with the cavity, constituting the resonator in the quasi-TM mode is not limited to being a rectangular parallelepiped. The shape may be another polyhedron, rather than a hexahedron, and also, may be columnar.

Moreover, by increasing the area of the center portion in the longitudinal direction of the dielectric core 3, as shown in FIG. 8, deterioration of the Q value in the TM mode is suppressed, which will be caused by effects of the conductor rod 4 passing through the center portion. Thus, the Q value can be enhanced.

Figure 9A:
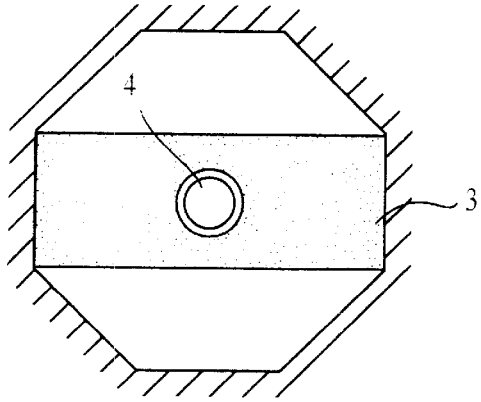
FIGS. 9A, 9B, and 9C show the shape of the dielectric cores and the cavity inner walls of a resonator device according to a sixth embodiment of the present invention.
Figure 9B:
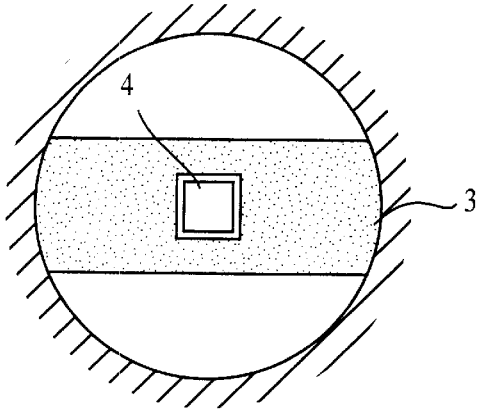
Figure 9C:
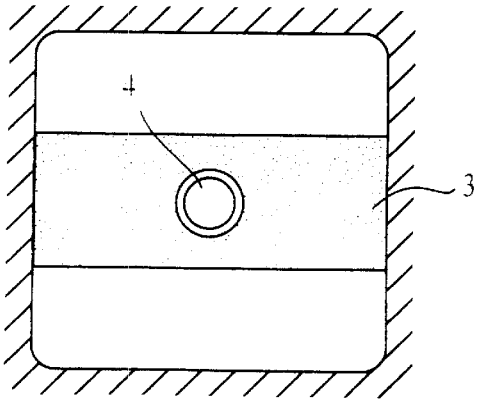

FIGS. 9A, 9B, and 9C are examples of the shapes in cross section of different cavities of a resonator device according to a sixth embodiment of the present invention. The shape in cross section of a cavity, taken in a plane perpendicular to the axial direction of the cavity is not limited to a square. The shape may be a polygon as shown in FIG. 9A, or may be circular as shown in FIG. 9B. Moreover, the inner wall of the cavity may be a combination of curved and flat planes, as shown in FIG. 9C. Moreover, the shape of the conductor rod 4 is not limited to a circle, and may be a prism, as shown in FIG. 9B. If the dielectric core 3 is provided with an angular hole corresponding to the shape of the conductor rod 4, the dielectric core 3 can be located in the axial direction by engagement of the dielectric core 3 with the conductor rod 4.

Next, the structure of a resonator device according to a seventh embodiment of the present invention will be described with reference to FIGS. 10A and 10B.

Figure 10A:
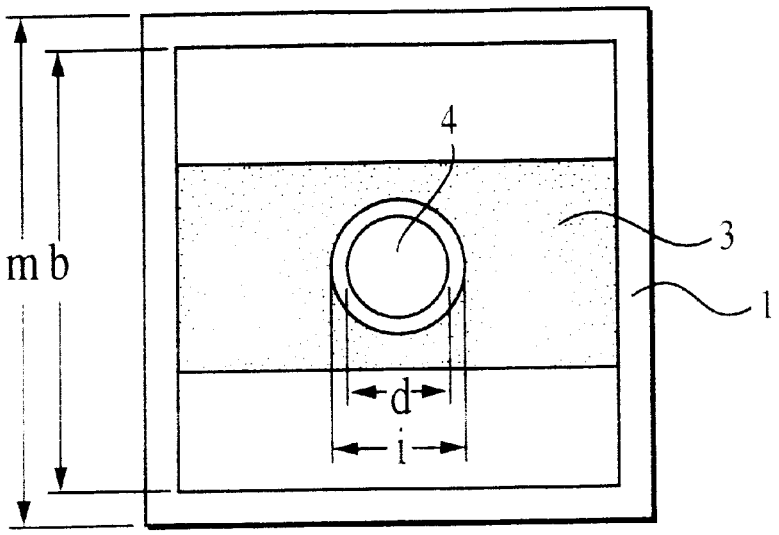
FIGS. 10A and 10B are a plan view and a cross section of a resonator device according to a seventh embodiment of the present invention.

FIG. 10A is a plan view of the resonator device before the cavity lid 2 is attached thereto. FIG. 10B is a center longitudinal cross Section of the resonator device having the cavity lid 2 attached thereto. In this embodiment, the top of the conductor rod 4 is electrically connected to the inner surface of the cavity lid 2. Accordingly, the cavity defined by the conductor rod 4, the conductor rod 4, and the cavity composed of the cavity body 1 and the cavity lid 2 constitute a coaxial cavity resonator. The coaxial cavity resonator acts as a half wave coaxial cavity resonator.

Figure 10B:
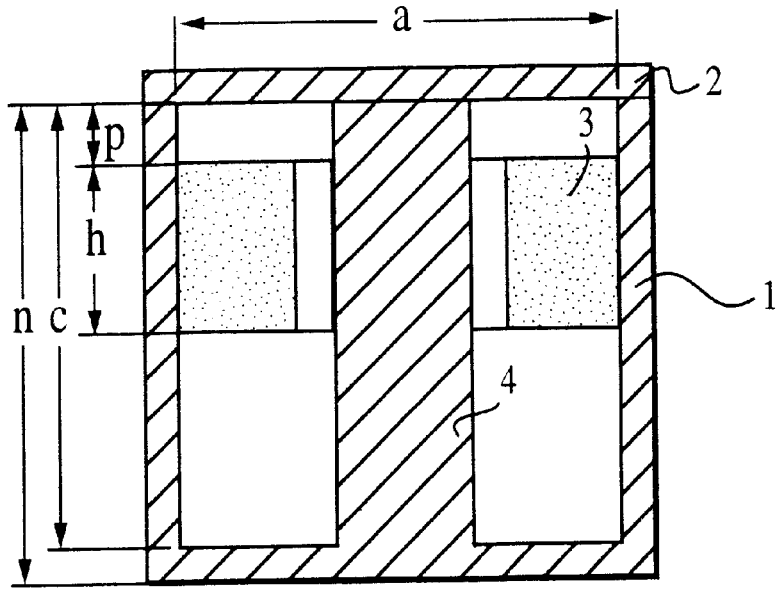

In one example, the sizes of the respective parts of the resonator device shown in FIGS. 10A and 10B are set as follows:

a=44 mm, b=44 mm, c=50 mm, d=11 mm, h=15 mm, i=15 mm, m=49 mm, n=47.5 mm, p=7.5 mm

In this example, the dielectric constant of the dielectric core 3 is 40, the resonance frequency in the TM010 mode is 1349 MHz, and that in the TEM mode is 1585 MHz.

Hereinafter, the structure of a resonator device according to an eighth embodiment of the present invention will be described with reference to FIGS. 11 to 15.

Figure 11:
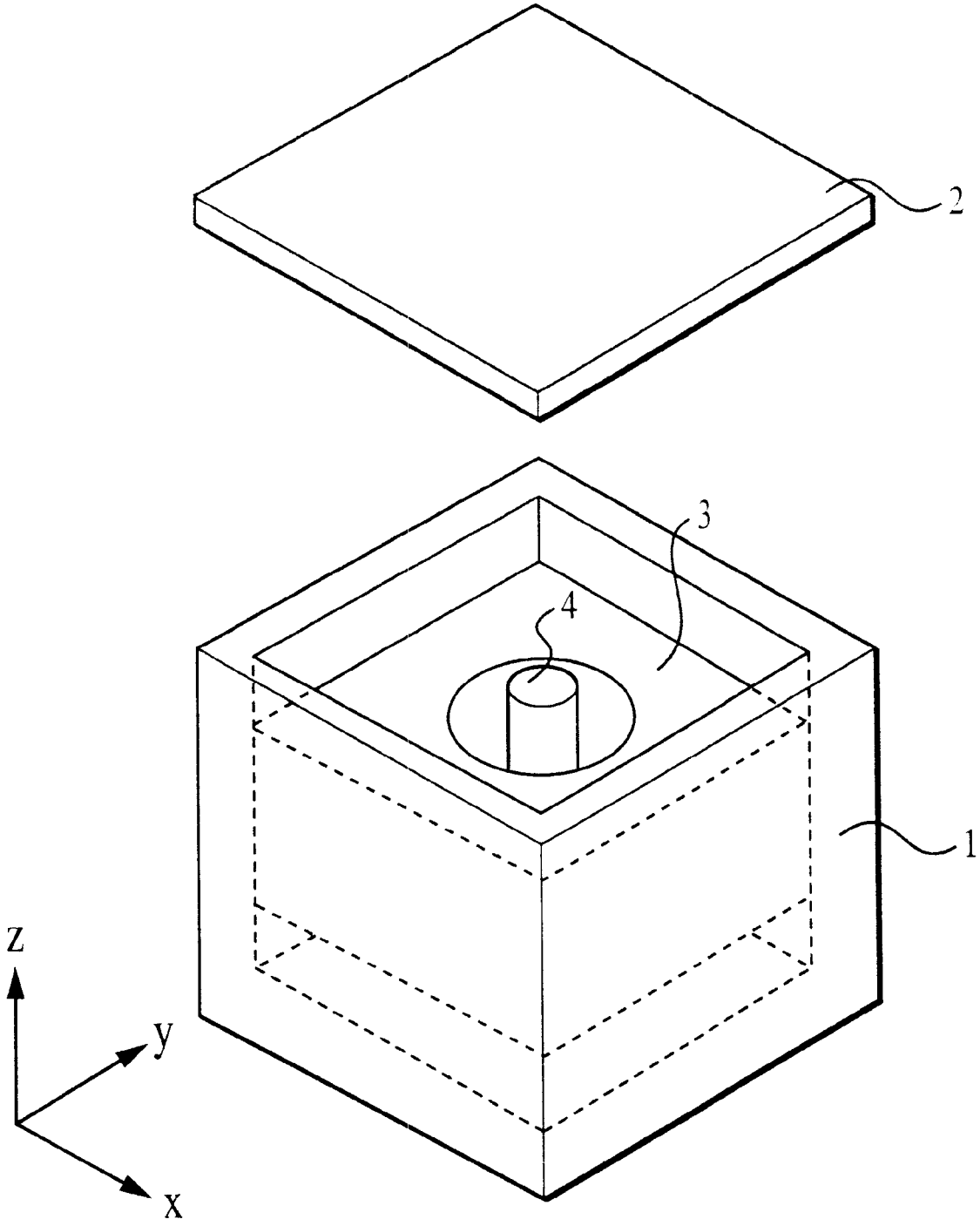
FIG. 11 is an exploded perspective view of a resonator device according to an eighth embodiment of the present invention.

FIG. 11 is an exploded perspective view of the resonator device. The conductor rod 4 is provided on the center axis of the cavity body 1. The dielectric core 3 is provided in the cavity body 1 in such a manner that the conductor rod 4 is inserted in and through a hole formed in the dielectric core 3. The cavity lid 2 is attached to the open upper side of the cavity body 1.

Figure 12A:
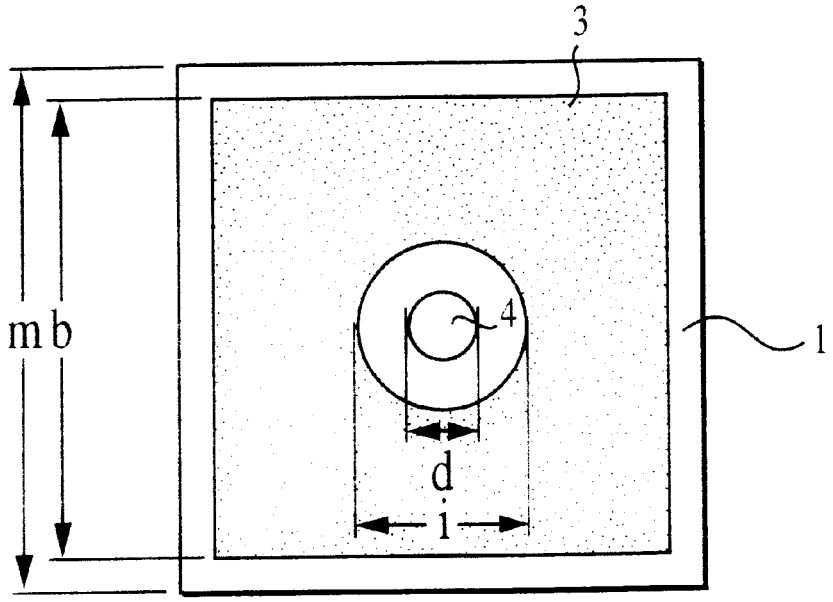
FIGS. 12A and 12B are a plan view and a cross section of the resonator device of the eighth embodiment.
Figure 12B:
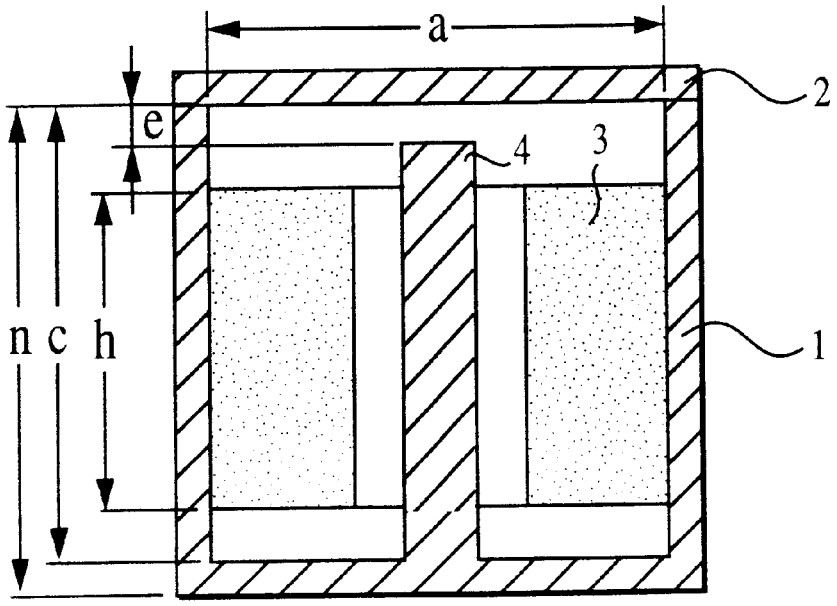

FIG. 12A is a plan view of the resonator device prior to the attachment of the cavity lid 2. FIG. 12B is a longitudinal cross section thereof. In the above-described first to sixth embodiments, a resonator in a single quasi-TM mode is formed. In the seventh embodiment, a resonator in double quasi-TM modes is formed, wherein the cross section in a plane perpendicular to the conductor rod or the axis of the quasi-TEM mode is a square.

Figure 13A:
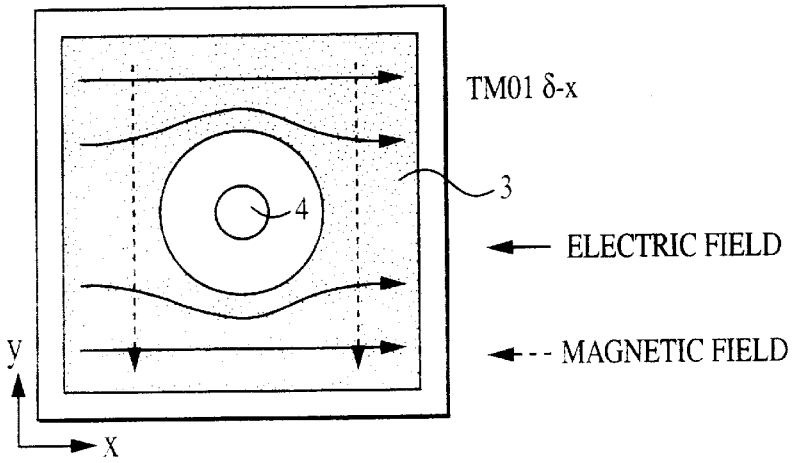
FIGS. 13A, 13B, and 13C show examples of the electromagnetic distributions in the three resonance modes of the resonator device of the eighth embodiment.
Figure 13B:
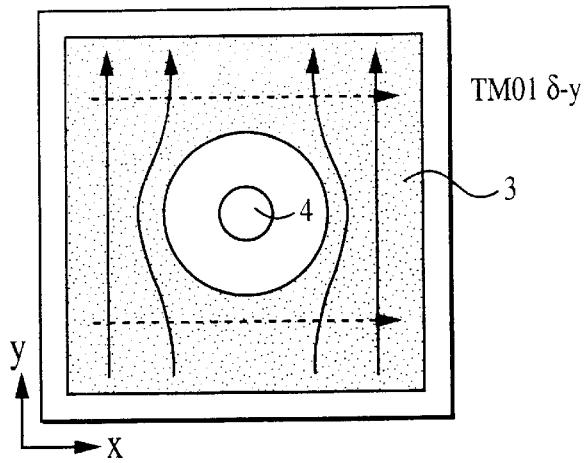
Figure 13C:
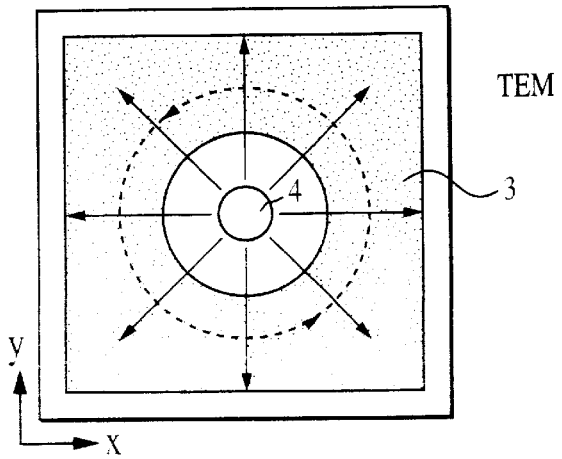

FIGS. 13A, 13B, and 13C illustrate examples of the electromagnetic field distributions in three resonance modes. FIGS. 13A and 13B show the $TM010_{-x}$ mode and the $TM010_{-y}$ mode, respectively. These two modes have a degenerate relation to each other. FIG. 13C shows the electromagnetic field distribution in the quasi-TEM mode, caused by the cavity and the conductor rod 4. In FIG. 13C, the solid line arrows represent the electric field vector, and the broken line arrows represent the magnetic field vector.

In this embodiment, similarly to the single TM mode described in the first embodiment and so forth, though the dielectric core has a rectangular parallelepiped shape, a circular cylindrical coordinate system is employed as the representation of a mode. The numbers of waves in the respective electric field intensity distributions are represented by the sequence of TMθrh, in which h represents the number of waves in the propagation direction, θ represents the number of waves in the turning-around direction in a plane perpendicular to the propagation direction, and r represents the number of waves in the radial direction in a plane perpendicular to the propagation direction. Furthermore, the propagation direction is represented by a subscript. Accordingly, in the $TM010_{-x}$, the magnetic field vector turns in parallel to the y-z plane of the dielectric core 3. In the $TM010_{-y}$ mode, the magnetic field vector turns in parallel to the x-z plane of the dielectric core 3.

Figure 14:
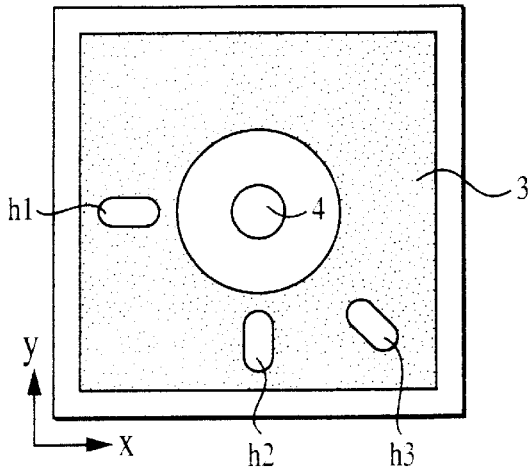
FIG. 14 shows coupling of the respective resonance modes of the resonator device of the eighth embodiment.

The structure of FIG. 14 shows one example of a way of coupling the above three modes. A coupling adjustment hole h1 for coupling the above quasi-TEM mode and the $TM010_{-x}$ mode is provided. In particular, the hole h1 is provided at one of the symmetric positions with respect to the conductor rod 4 in the direction in which the electric field vectors in the $TM010_{-x}$ mode and the quasi-TEM mode are directed in parallel to each other. Thereby, the balance at the symmetric positions of the electric field intensity in the quasi-TEM mode with that in the $TM010_{-x}$ mode is disturbed, so that both of the modes are coupled together. Similarly, a coupling adjustment hole h2 for coupling the above-mentioned quasi-TEM mode and the $TM010_{-y}$ mode together is provided. In particular, the hole h2 is provided at one of the symmetric positions with respect to the conductor rod 4 in the direction in which the electric field vectors in the $TM010_{-y}$ mode and the quasi-TEM mode are directed in parallel to each other. Thereby, the balance at the symmetric positions of the electric field intensity in the quasi-TEM mode with that in the $TM010_{-y}$ mode is disturbed, so that both of the modes are coupled together.

As shown in FIG. 14, a coupling adjustment hole h3 for coupling the $TM010_{-x}$ and $TM010_{-y}$ together is provided. With the coupling adjustment hole h3, a difference is caused between the resonance frequencies in the odd mode and the even mode which are produced by coupling both of the two modes. Thereby, the degenerate relation of both of the modes is solved, so that both of the modes are coupled to each other.

Figure 15A:
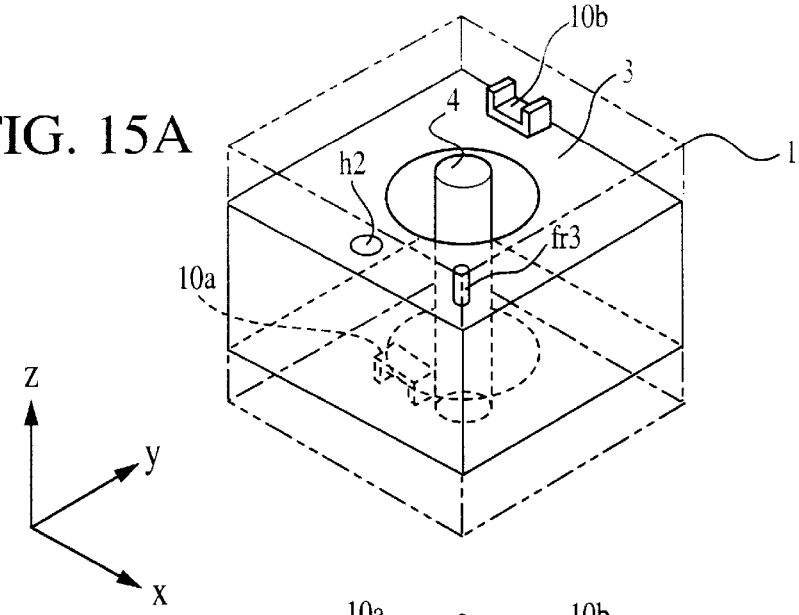
FIGS. 15A and 15B are perspective views of examples of the resonator device of the eighth embodiment in which input-output portions are provided.
Figure 15B:
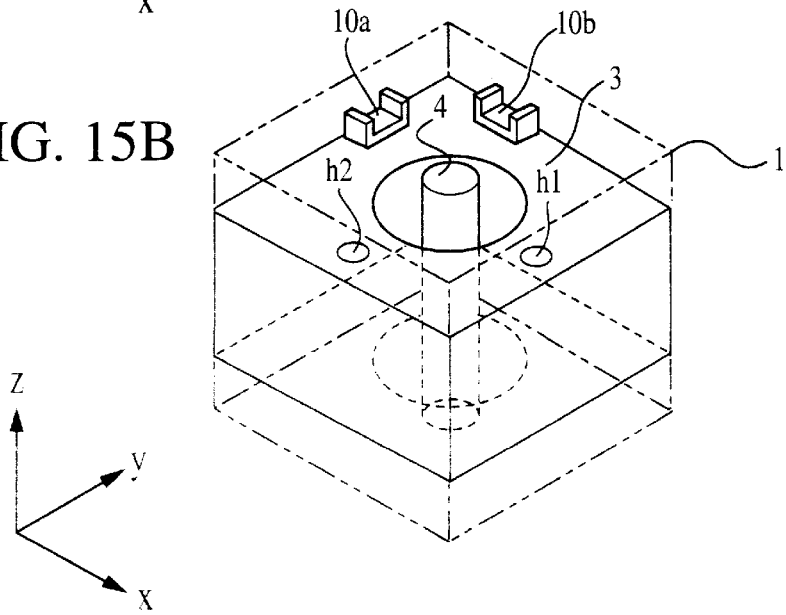

FIGS. 15A and 15B show two examples of a filter comprising three filter stages, formed by coupling the above-described three resonance modes. The intensity of the magnetic field in the TEM mode is stronger in the lower part of the resonator, and the intensity of the magnetic field in the TM mode is weaker at a position more distant from the dielectric core 3. In the example shown in FIG. 15A, the magnetic field in the quasi-TEM mode, caused by the conductor rod 4 and the cavity, is passed through a coupling loop 10*a*. Thus, the coupling loop 10*a* is coupled to the quasi-TEM mode. At this time, the coupling degree of the coupling loop 10*a* and the TM mode is so small as to be negligible. Furthermore, the magnetic field in the $TM010_{-x}$ mode is passed through a coupling loop 10*b*. Thus, the coupling loop 10*b* is coupled to the $TM010_{-x}$ mode. Moreover, the coupling adjustment hole h2 causes the quasi-TEM mode and the $TM010_{-x}$ mode to couple together. The coupling adjustment hole h2 causes the $TM010_{-x}$ mode and the $TM010_{-y}$ mode to be coupled together. The coupling adjustment hole h3 causes the $TM010_{-x}$ mode and the $TM010_{-y}$ mode to couple together. Thus, when the coupling loop 10*a* and the coupling loop lob are set to be input and output portions, respectively, the quasi-TEM mode, the $TM010_{-y}$ mode, and the $TM010_{-x}$ are coupled sequentially in that order. Thus, this device functions as a filter composed of three resonator stages.

In the example of FIG. 15B, the magnetic field in the $TM010_{-y}$ mode is passed through the coupling loop 10*a*. Thus, the coupling loop 10*a* is coupled to the $TM010_{-y}$ mode. Moreover, the magnetic field in the $TM010_{-x}$ mode is passed through the coupling loop 10*b*. Accordingly, the coupling loop 10*b* is coupled to the $TM010_{-x}$ mode. The coupling adjustment hole h1 causes the quasi-TEM mode and the $TM010_{-x}$ mode to couple together. The coupling adjustment hole h2 causes the quasi-TEM mode and the $TM010_{-y}$ mode to couple together. Accordingly, when the coupling loops 10*a* and 10*b* are set to be input and output portions, respectively, the $TM010_{-y}$ mode, the quasi-TEM mode, and the $TM010_{-x}$ mode are coupled, sequentially in that order. Thus, this device functions as a filter composed of three stage filters.

In one example, the sizes of the respective parts of the resonator as shown in FIG. 12 are set as listed below:

a=44 mm, b=44 mm, c=50 mm, d=12 mm e=4 mm, h=35 mm, i=26 mm, m=49 mm, n=52.5 mm

When the dielectric constant of the dielectric core 3 is set at 40, the resonance frequencies in the $TM010_{-x}$ mode, the $TM010_{-y}$ mode, and the quasi-TEM mode are 1072 MHZ, 1072 MHZ, and 983 MHZ, respectively.

Next, the structure of a resonator device according to a ninth embodiment of the present invention will be described with reference to FIGS. 16A–16B.

Figure 16A:
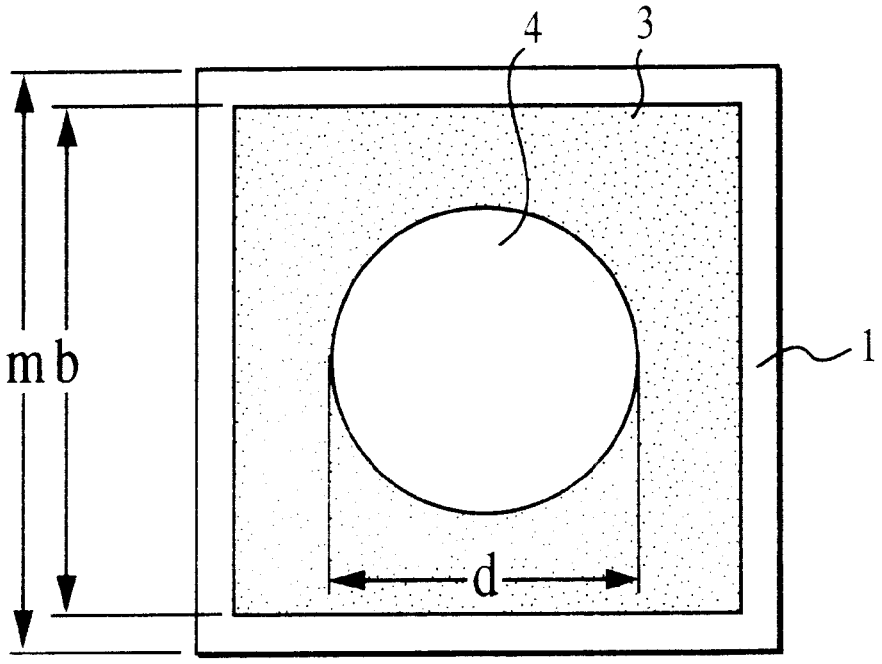
FIGS. 16A and 16B are a plan view and a cross section of a resonator device according to a ninth embodiment of the present invention.
Figure 16B:
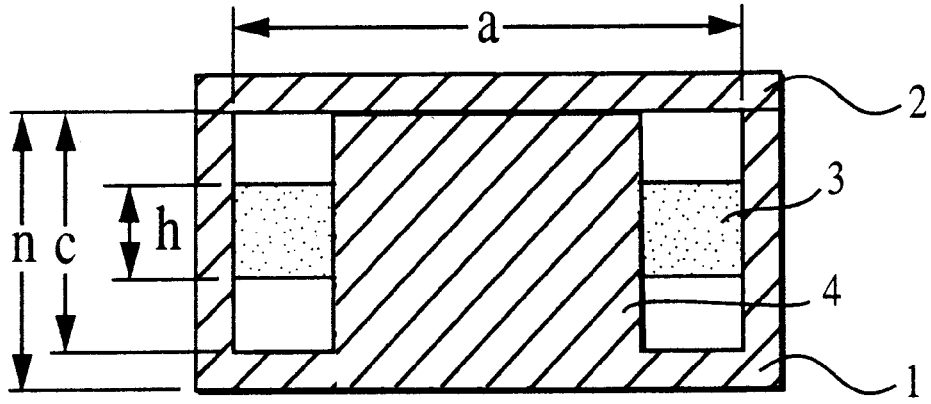

FIG. 16A is a plan view of the resonator prior to the attachment of the cavity lid 2. FIG. 16B is a center longitudinal cross section of the resonator having the cavity lid 2 attached thereto. In this embodiment, the top of the conductor rod 4 is electrically connected to the inner surface of the cavity lid 2. Accordingly, the conductor rod 4, the cavity body 1, and the cavity lid 2 constitute a coaxial cavity resonator. This coaxial cavity resonator functions as a half-wave coaxial cavity resonator.

The sizes of the respective parts of the resonator shown in FIG. 16 may be as listed below:

a=44 mm, b=44 mm, c=15 mm, d=26 mm, h=5 mm, m=49 mm, n=17.5 mm

In this example, the dielectric constant of the dielectric core 3 is set at 40, the resonance frequencies in the $TM010_{-x}$ mode, the $TM010_{-y}$ mode, and the TEM mode are 2047 MHZ, 2047 MHZ, and 1970 MHZ.

FIGS. 17A and 17B to 19A, 19B, and 19C show examples of various structures of the dielectric core 3 of a resonator device according to a tenth embodiment of the present invention, and examples of various types of attachment of the dielectric core 3 inside of the cavity.

Figure 17A:
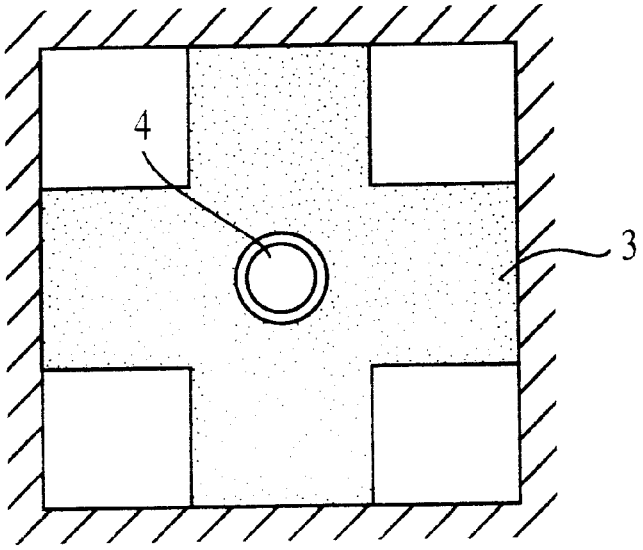
FIGS. 17A and 17B show examples of the shapes of the dielectric core and the cavity inner wall of the resonator device of the ninth embodiment.
Figure 17B:
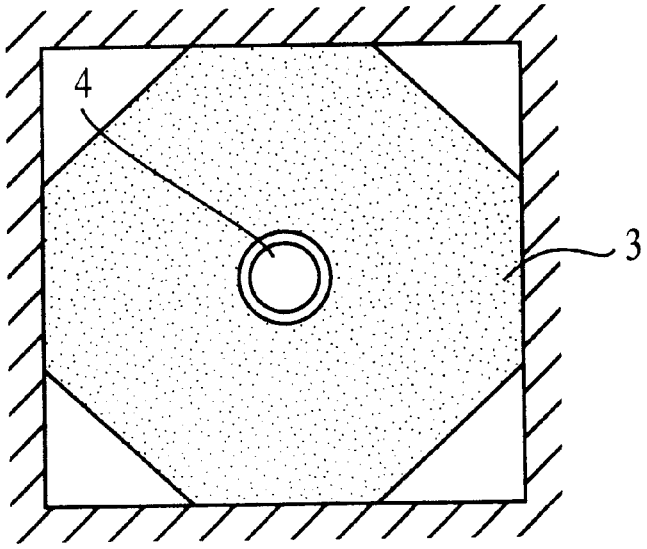

These figures are plan views taken in the axial direction of the conductor rod 4. In the example of FIG. 17A, the dielectric core 3 has a cross shape. In the example of FIG. 17B, the dielectric core 3 takes a square shape of which the four comers are cut off. In these shapes, the area where each dielectric core contacts with the cavity is reduced. Thus, deterioration of the Q value in the conductor can be prevented.

Figure 18A:
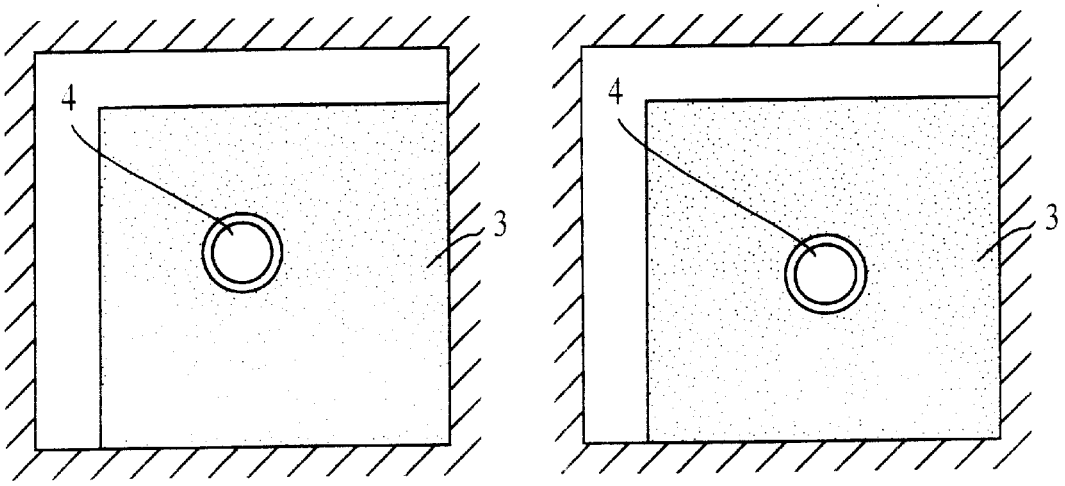
FIG. 18A, 18B, and 18C show examples of the shape of the other dielectric core and cavity inner wall of the resonator device of the ninth embodiment.
Figure 18B:
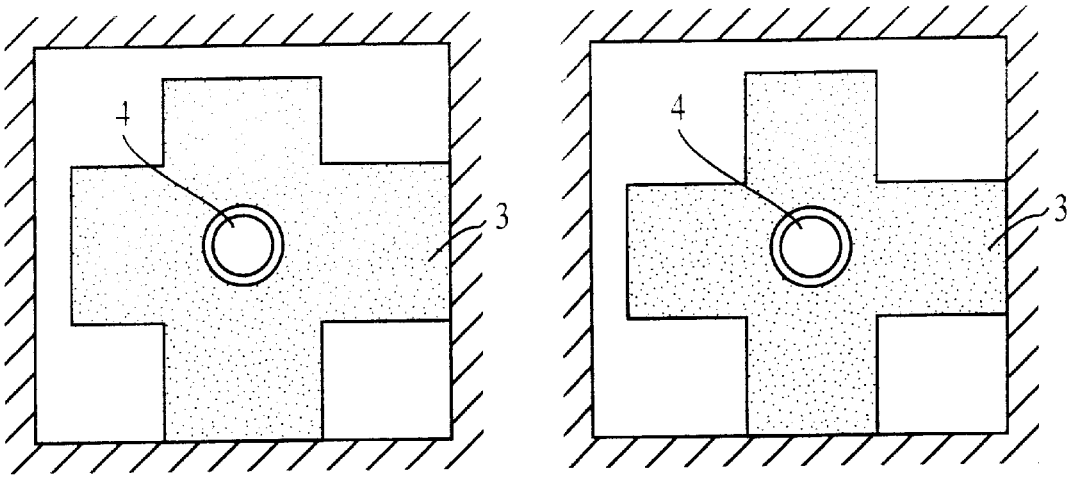
Figure 18C:
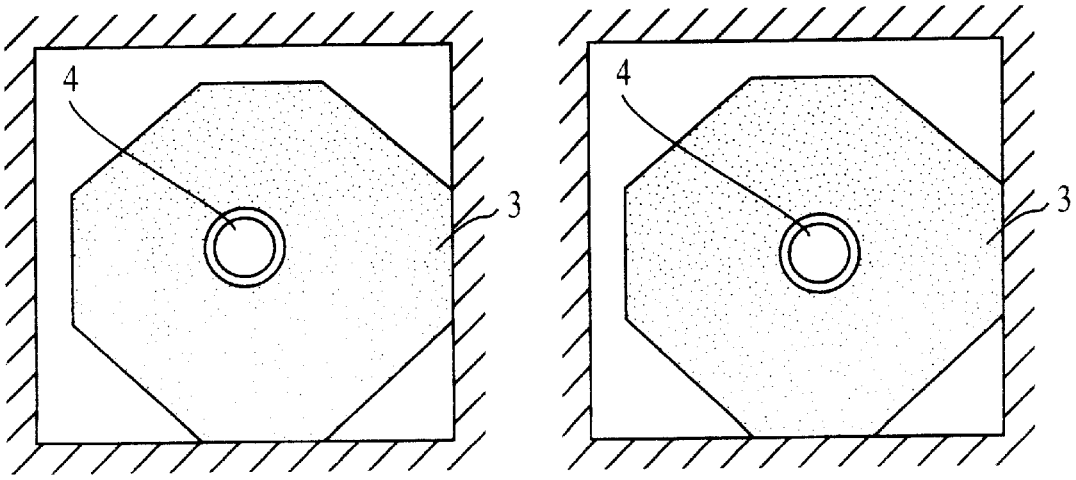

In the respective examples of FIGS. 18A, 18B, and 18C, the faces of the dielectric core 3 are spaced from the inner walls in two directions of the cavity.

In the examples of FIG. 18A, the dielectric core 3 having a square shape is used. In the examples of FIG. 18B, the dielectric core 3 having a cross shape is used. In the examples of FIG. 18C, the dielectric core 3 having an octagonal shape is employed. In the figures on the left-hand sides of FIGS. 18A, 18B, and 18C, the conductor rod 4 is disposed on the center axis of the cavity. In the figures on the right-hand sides, the conductor rod 4 is disposed in the center of the dielectric core 3. The two modes produced when the faces of each dielectric core 3 are spaced from the two adjacent inner walls of the cavity can be expressed as $TM01\delta_{-x}$ and $TM01\delta_{-y}$ modes. With each of these structures, the static capacitance between the opposed cavity inner walls can be reduced. By increasing the size of the cavity correspondingly to the reduction of the static capacitance, the Q value of the resonator can be further enhanced.

Figure 19A:
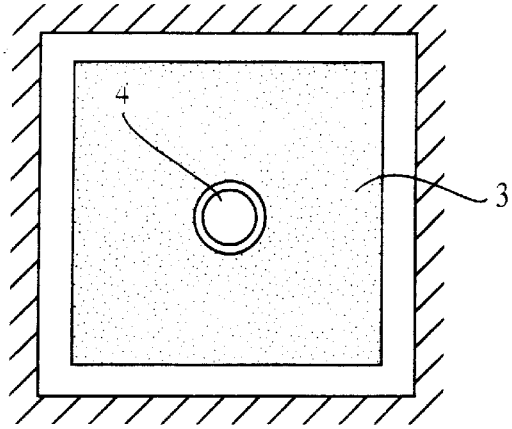
FIGS. 19A, 19B, and 19C show examples of the shape of another dielectric core and cavity inner wall of the resonator device of the ninth embodiment.
Figure 19B:
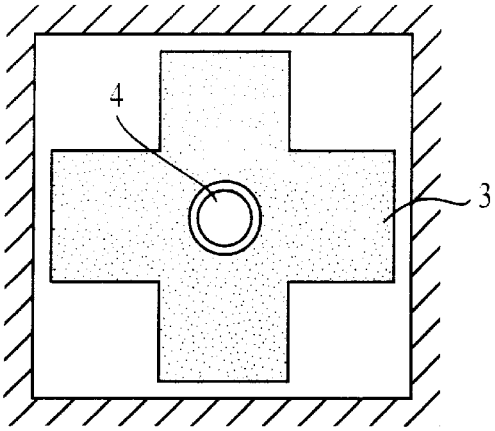
Figure 19C:
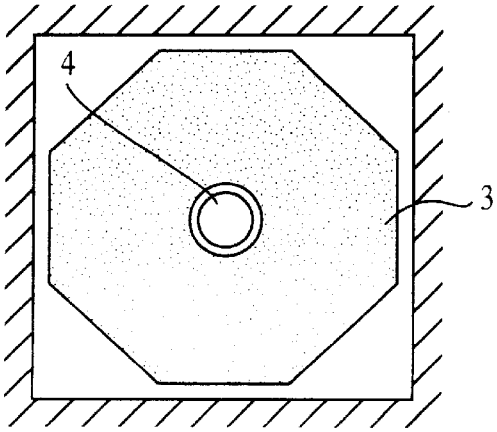

In the respective examples of FIGS. 19A, 19B, and 19C, the faces of the dielectric core 3 are spaced from all of the inner walls of the cavity, respectively. With these structures, the Q value of each resonator can be further enhanced.

The structures of a resonator device according to an eleventh embodiment of the present invention will be described with reference to FIGS. 20 to 23A and 23B.

Figure 20:
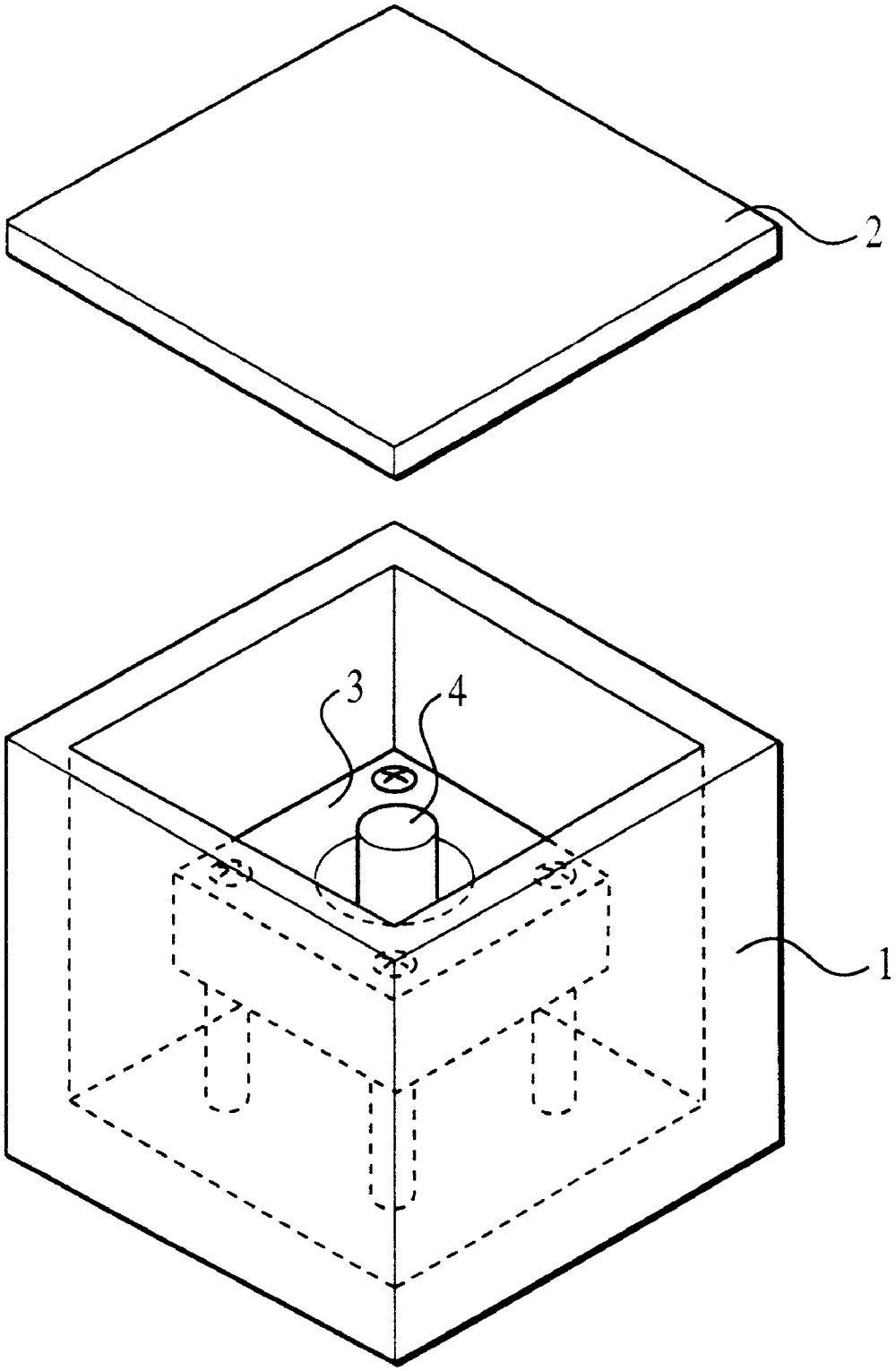
FIG. 20 is an exploded perspective view of a resonator device according to an eleventh embodiment of the present invention.

FIG. 20 is an exploded-perspective view of the resonator device. The resonator device contains the cavity body 1 having a substantially-rectangular parallelepiped shape of which the upper side is open, and the underside is closed, and the cavity lid 2 for covering the open side of the cavity body 1. The conductor rod 4 is projected from the center of the inner bottom of the cavity body 1 in parallel to the inner walls of the cavity. The dielectric core 3 shown in FIG. 20 takes a substantially square shape, and has a hole which the conductor rod 4 is inserted in and through.

Figure 21A:
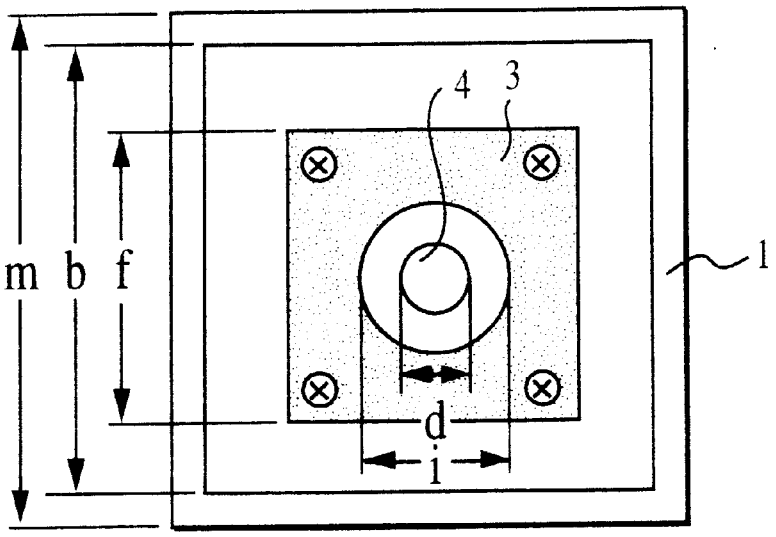
FIGS. 21A and 21 are a plan view and a cross section of the resonator device of the eleventh embodiment.
Figure 21B:
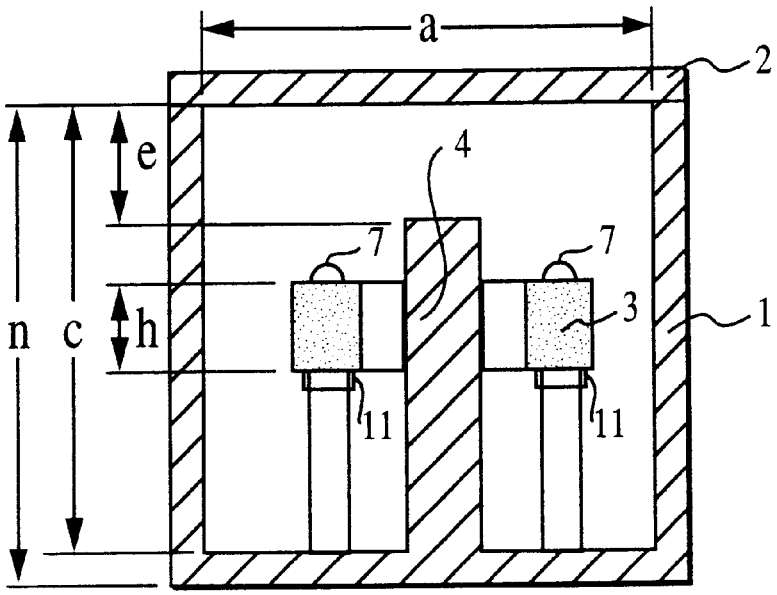

FIG. 21A is a plan view of the resonator device prior to the attachment of the cavity lid 2. FIG. 21B is a center longitudinal cross section of the resonator device having the cavity lid 2 attached thereto. The conductor rod 4 is formed integrally with the cavity body 1. The top of the conductor rod 4 has a predetermined space from the inner surface of the cavity lid 2. The dielectric core 3 is fixed at a predetermined height in the cavity by means of screws 7 and nuts 11. The conductor rod 4 may be formed separately from the cavity body 1 and fixed to the cavity body 1.

Figure 22A:
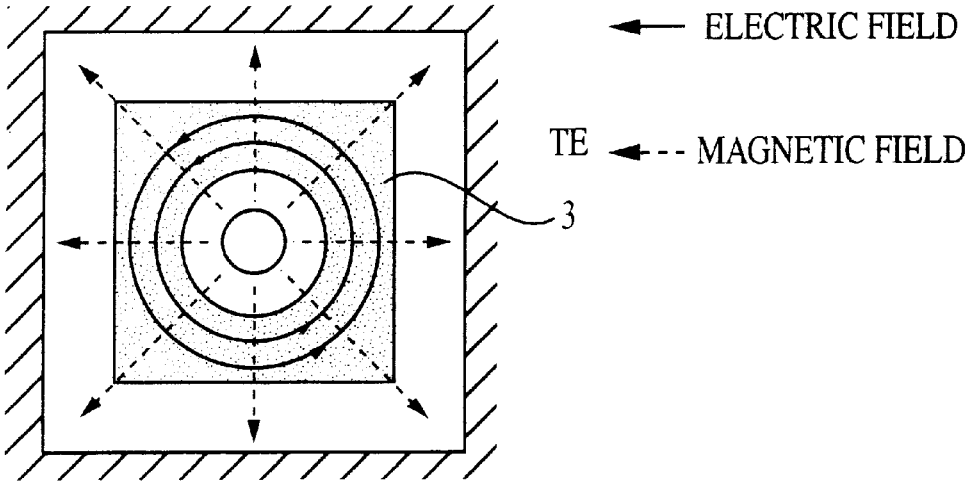
FIGS. 22A and 22B show an example of the structure of the resonator device of the eleventh embodiment and an example of the electromagnetic field distribution in one resonance mode, respectively.
Figure 22B:
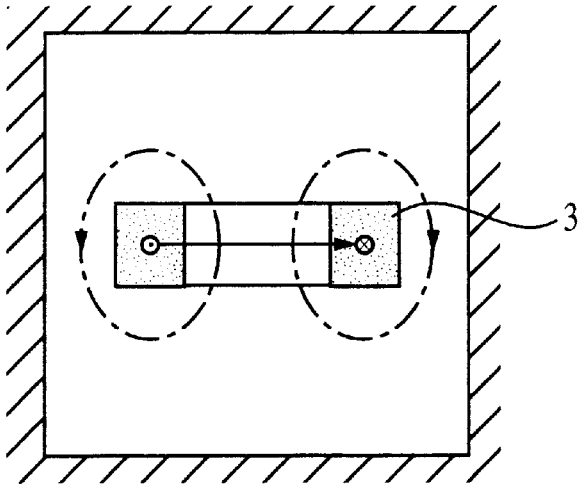

FIGS. 22A and 22B show an example of the electromagnetic field distribution in the TE mode of this resonator device. FIG. 22A is a plan view of the resonator device. FIG. 22B is a front view thereof. In these figures, the solid line arrows indicate the electric field vector, and the broken line arrows indicate the magnetic field vector. In the TE mode caused by the dielectric core 3, the electric field vector forms a loop in the in-plane direction of the dielectric core. Magnetic field loops are distributed perpendicularly to the electric field direction, in a toroidal form. In this example, though the dielectric core has a square shape, a circular cylindrical coordinate system is employed as the representation of a mode. The numbers of waves in the respective magnetic field intensity distributions are represented by the sequence of $TM\theta rh$, in which h represents the number of waves in the propagation direction, θ represents the number of waves in the turning-around direction in a plane perpendicular to the propagation direction, and r represents the number of waves in the radial direction in a plane perpendicular to the propagation direction. Accordingly, the mode in this embodiment is represented as the TM01δ mode. The dielectric core 3 has neither a disk shape nor a columnar shape. The mode is named a quasi-TE mode.

Also, the quasi-TEM mode is generated as an additional resonance mode, caused by the conductor rod 4 and the cavity, as well as in the above-described embodiments.

Figure 23A:
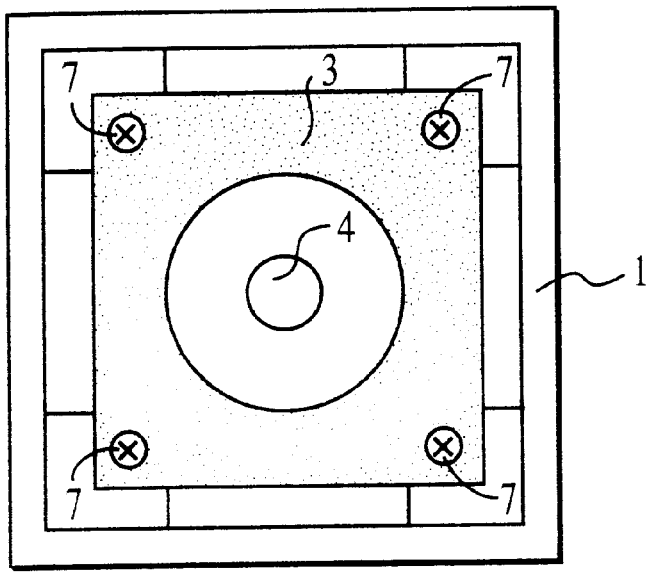
FIGS. 23A and 23B show an example of another structure of the resonator device of the eleventh embodiment.
Figure 23B:
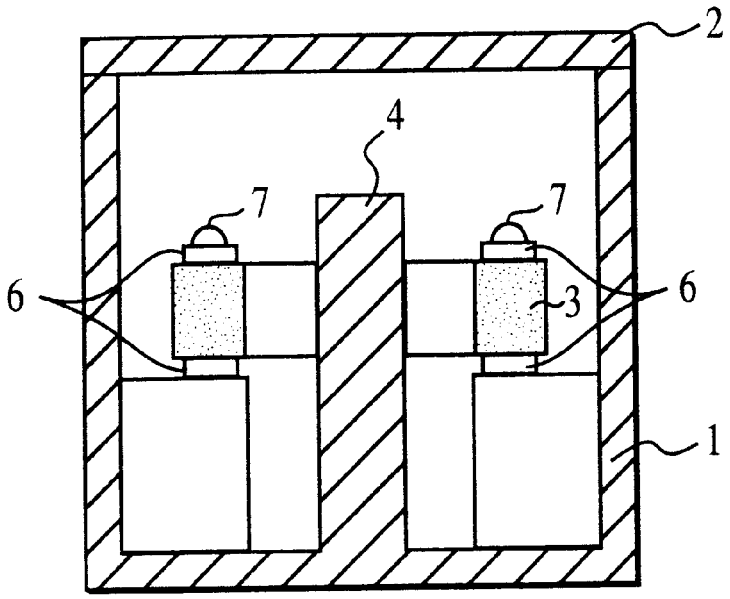

FIGS. 23A and 23B show an example of the structure inside of another cavity. FIG. 23A is a plan view- of the resonator device prior to the attachment of the cavity lid 2. FIG. 23B is a center cross section thereof. In this example, a step portion for supporting the bottom of the dielectric core 3 is provided inside of the cavity body 1. The dielectric core 3 is fixed to the step portion by screwing screws 7 through spacers 6 having a low dielectric constant, respectively. With this structure, the fixing strength (rigidity) of the dielectric-core 3 can be enhanced.

Figure 24A:
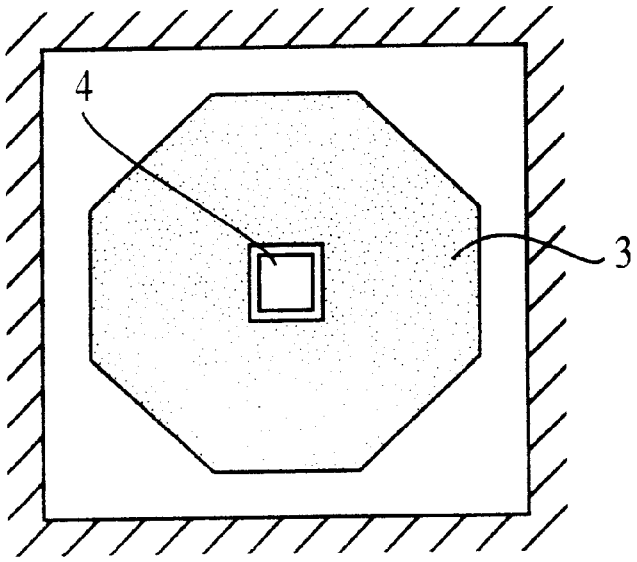
FIGS. 24A and 24B show examples of the dielectric core and cavity of a resonator device according to an eleventh embodiment of the present invention.

FIGS. 24A, 24B to 26A, 26B, and 26C are examples of a resonator device according to a twelfth embodiment of the present invention, in which the shapes and attachment positions of the dielectric core 3 are different. These figures are plan views of the resonator device as viewed in the axial direction of the conductor rod 4, respectively. In the example of FIG. 24A, the dielectric core 3 has an octagonal shape which is similar to a square shape dielectric plate having the four corners thereof cut off. The conductor rod 4 has a prism shape, and the hole of the dielectric core 3 is square in section. Thereby the dielectric core 3 can be located with respect to the axis of the dielectric core 3.

Figure 24B:
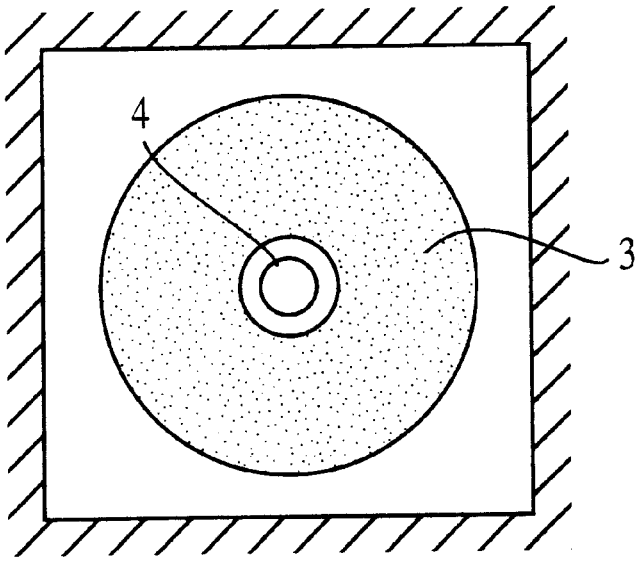

FIG. 24B shows an example of the resonator including the dielectric core 3 having a disk shape. With such a structure, a resonator can be obtained in which generation of spurious modes other than the employed TE01δ mode is suppressed. The inner wall of the cavity may be cylindrical correspondingly to the shape of the dielectric core 3.

Figure 25A:
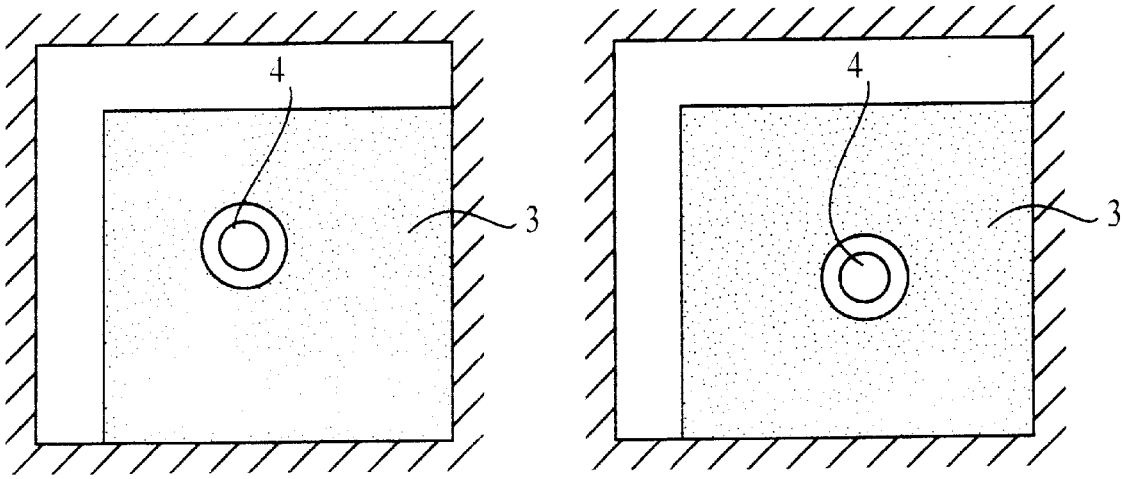
FIGS. 25A and 25B show examples of another dielectric core and inner wall of the resonator device of the eleventh embodiment.
Figure 25B:
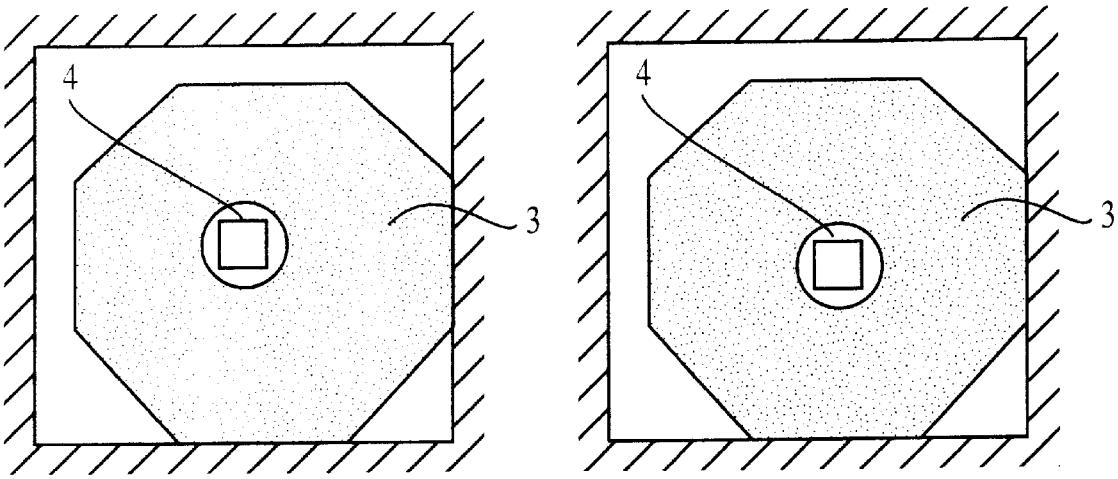
Figure 26A:
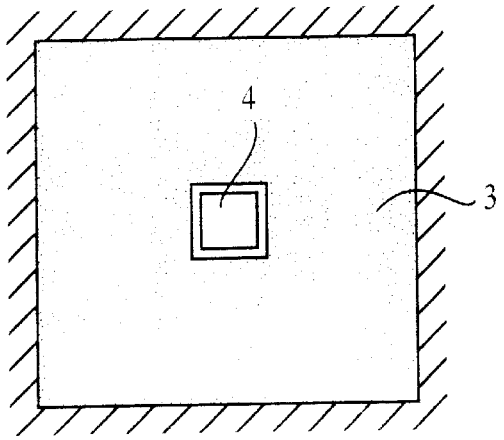
FIGS. 26A, 26B, and 26C show examples of yet another dielectric core and inner wall of the resonator device of the eleventh embodiment.
Figure 26B:
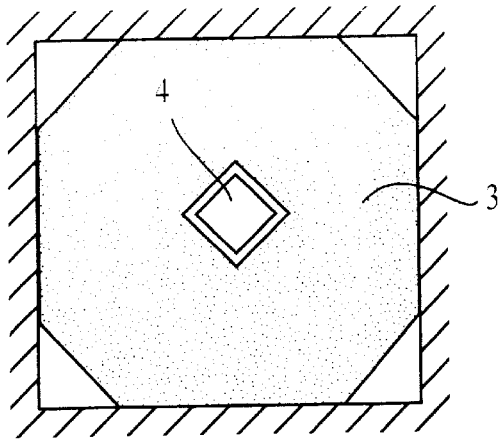
Figure 26C:
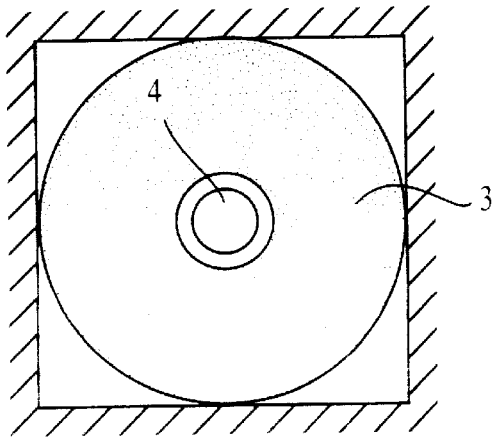

FIGS. 25A and 25B show examples of the resonator device in which the dielectric core 3 is bonded to two adjacent faces of the cavity. FIGS. 26A, 26B, and 26C show examples in which the dielectric core 3 is bonded to or is brought into contact with all of the-inner walls of the cavity, respectively.

Hereinafter, a method of producing the above resonator device will be described.

In the resonator device of the present invention, the resonance frequency in the above-described quasi-TM mode, caused by the cavity and the dielectric core 3, and that of the above-described quasi-TEM mode, caused by the cavity and the conductive rod, are set at substantially the same value to couple both of the modes. However, in this case, the question is that in general, the temperature characteristics (characteristics of resonance frequency change versus temperature change) of these modes are considerably different from each other. In any of the above-described resonance modes, the size of the cavity is one of the factors by which the resonance frequency is determined. That is, when the cavity is distorted, due to the change of temperature, the resonance frequencies of the two modes are changed. Thus, the temperature characteristics of the two modes can be stabilized by using a metallic material having a low linear expansion coefficient such as Invar or the like. However, the above metallic materials with a low linear expansion coefficient such as Invar and so forth are expensive. Thus, inevitably, the cost of the resonator device as a whole becomes high. In the embodiments described below, a resonator device having a good temperature characteristic is formed by use of a metallic material such as aluminum or the like which is inexpensive, and can be integrally molded.

Changes in the resonance frequencies in the quasi-TM and quasi-TEM modes were measured with the dielectric constant of the dielectric core 3 being varied, in the structures of the resonator device shown in FIGS. 1 to 3. The following table shows the results.

TABLE 1

| εr | 38 | 39 | Δfo [MHZ] |
|---|---|---|---|
| $f_0$ quasi-TM mode | 1986.83 | 1962.79 | −24.0 |
| $f_0$ quasi-TEM mode | 2053.38 | 2051.82 | −1.6 |

As seen in Table 1, the resonance frequency in the quasi-TM mode considerably depends on the dielectric constant of the dielectric core 3. On the other hand, the resonance frequency in the quasi-TEM mode hardly depends on the dielectric constant of the dielectric core 3.

With distortion of the cavity caused by changes in temperature, the resonance frequencies in the quasi-TM and quasi-TEM modes are changed. In each of the modes, the change of the resonance frequency with temperature has a negative coefficient. Accordingly, a dielectric material having such a dielectric constant that presents a negative temperature coefficient is employed for the dielectric core 3.

Thus, the dielectric constant can be determined so as to stabilize the temperature characteristic of the resonance frequency in the quasi-TM mode, as described later.

Figure 32:
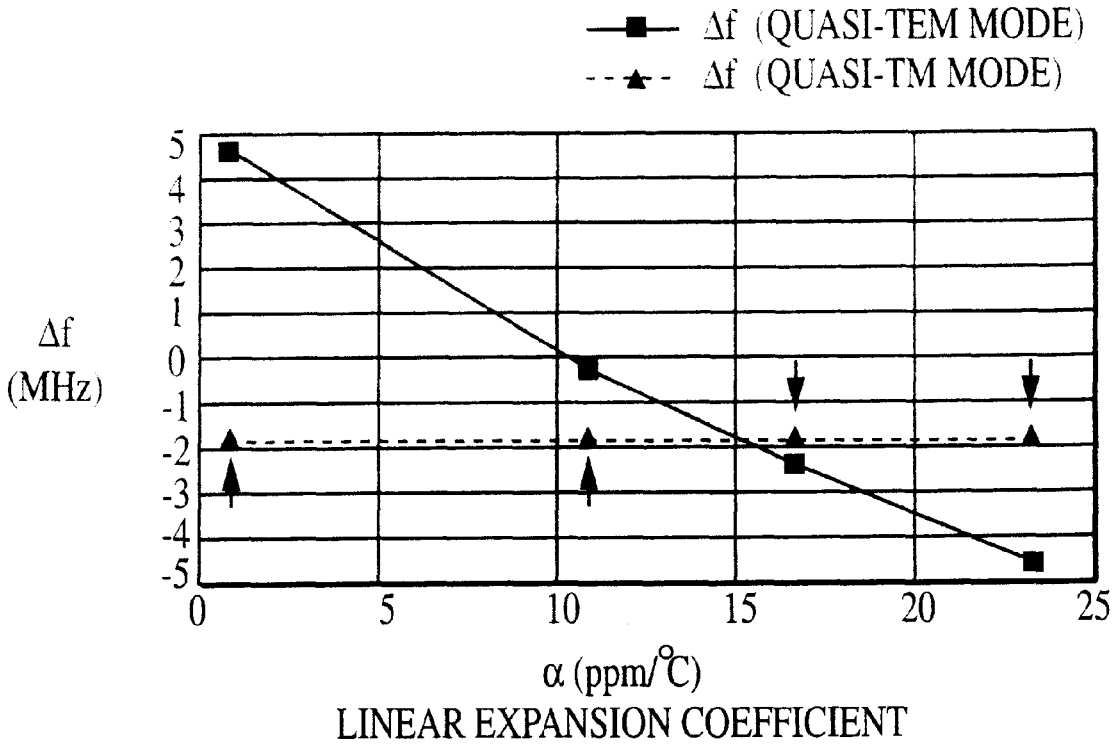
FIG. 32 is a graph showing examples of the change of the resonance frequencies in two modes with temperature, caused by the different linear expansion coefficients of conductor rods.

Next, the relation between the linear, expansion coefficient of the conductor rod 4 and the change of the resonance frequency was measured. FIG. 32 shows the results. In this case, the cavity body 1 was formed-from aluminum, and the conductor rod 4 was formed from any one of four types of material, namely, Invar, iron, copper, or aluminum. A change Δf in the resonance frequency, caused when the temperature was changed by 60° C., is shown in FIG. 32.

When the conductor rod 4 is formed from Invar, the length of the conductor rod 4 doesn't substantially change, even if the temperature is varied. With the expansion of the cavity caused by rising of the temperature, the gap between the top of the conductor rod 4 and the cavity lid 2 is increased, so that the static capacitance, produced in the gap, is decreased. Thus, the resonance frequency in the quasi-TEM mode is considerably increased.

If the conductor rod 4 is made of aluminum as well as the cavity body 1, the conductor rod 4 expands or shrinks together with the cavity, in response to changes in temperature, so that the gap between the top of the conductor rod 4 and the cavity lid 2 is not significantly varied. On the other hand, the conductor rod 4 is elongated with the rise of temperature, resulting in decreasing the resonance frequency in the quasi-TEM mode.

When copper and iron having a low linear expansion coefficient are used as material for the conductor rod 4, the resonance frequency in the-quasi-TEM mode is changed with temperature, correspondingly to the respective linear expansion coefficients of the materials.

On the other hand, the resonance frequency in the quasi-TM-mode is substantially constant, irrespective of materials for the conductor rod 4, and the expansion and shrinkage thereof. Accordingly, the temperature characteristic of the quasi-TEM mode can be determined, independently of the characteristic of the quasi-TM mode, by selecting a metallic material having such a linear expansion coefficient that the change of the resonance frequency in the quasi-TEM mode with temperature becomes substantially constant. In the example of FIG. 32, the resonance frequency in the quasi-TEM mode can be stabilized for temperature change by using iron as material for the conductor rod 4.

Figure 33A:
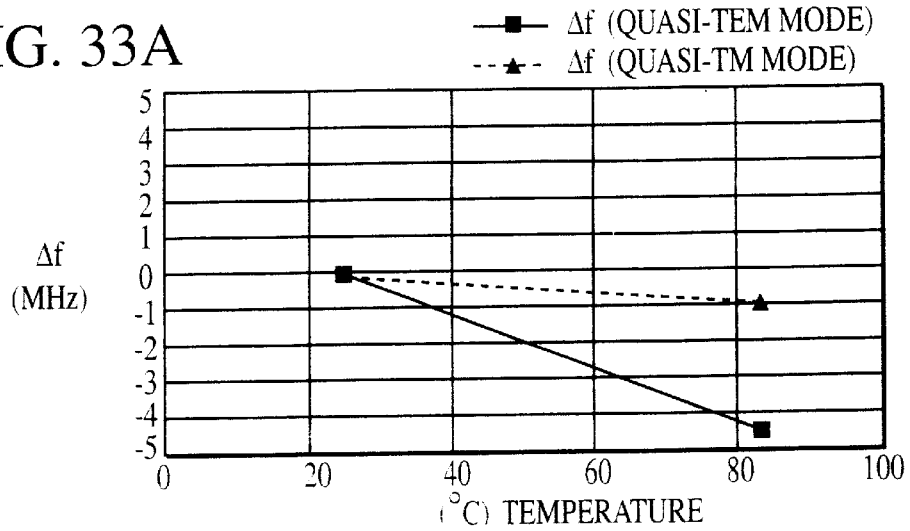
FIGS. 33A, 33B, and 33C show procedures for setting the temperature characteristics of the two modes.
Figure 33B:
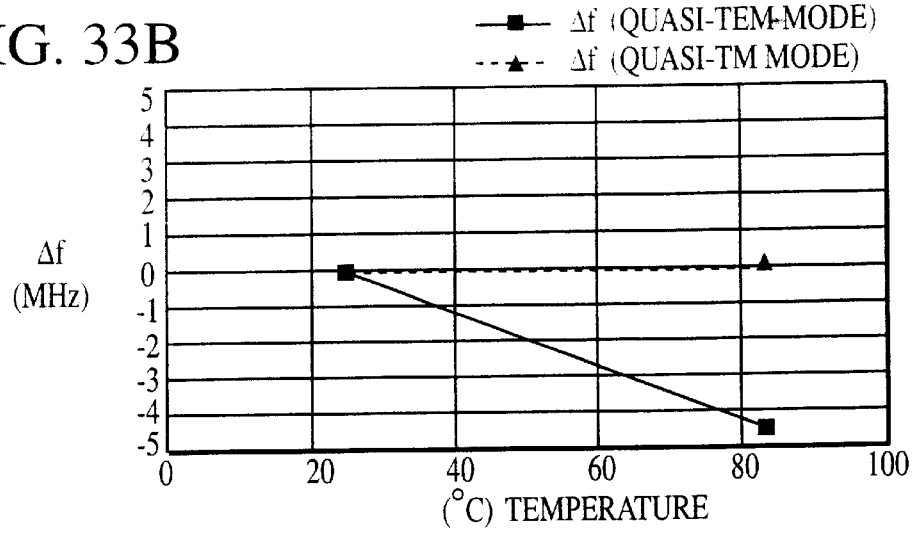
Figure 33C:
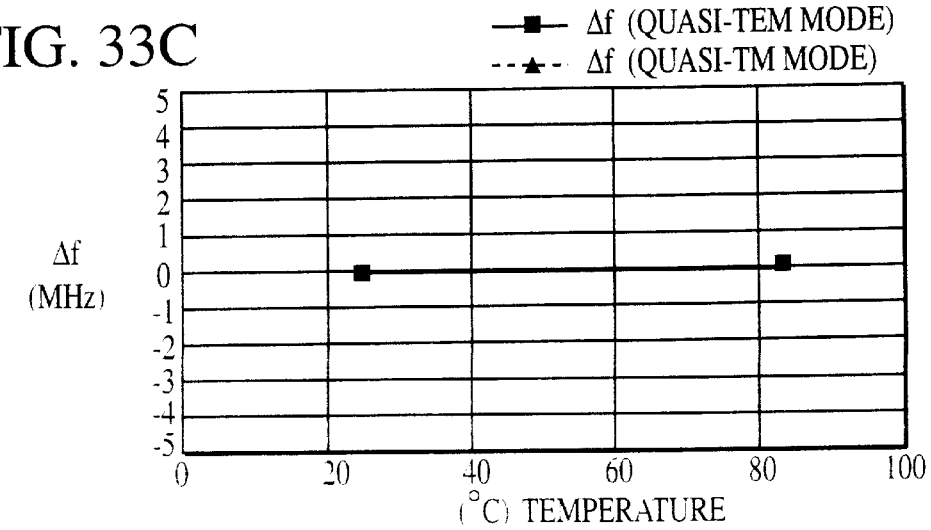

FIGS. 33A, 33B, and 33C show the procedures for controlling the temperature characteristics of the resonance frequencies in the two modes, that is, the quasi-TM and quasi-TEM modes.

(Step 1)

First, material for the conductor rod 4 which is the same as that of the cavity body 1 is used, and the dielectric core 3 is formed from a dielectric material having such a dielectric constant ∈r that presents a temperature coefficient of zero. The temperature characteristics of both of the modes are determined. FIG. 33A shows the temperature characteristics. As described above, the resonance frequency in the quasi-TM is decreased, due to the enlargement of the space in the cavity caused by a rise in temperature.

(Step 2)

Next, by the analysis of the electromagnetic field in the quasi-TM mode, the amount of change of the resonance frequency, caused by changing the dielectric constant of the dielectric core 3, is determined. The temperature characteristic of the dielectric constant of the dielectric core 3 is determined in such a manner that the amount of change of the resonance frequency in the quasi-TM mode with temperature, determined in Step 1, is made zero. In particular, a dielectric material is selected such that the temperature coefficient of the dielectric constant ∈r of the dielectric core 3 has a predetermined negative value, and the resonance frequency in the quasi-TM mode for changes in temperature becomes constant. FIG. 33B shows the temperature characteristic. The resonance frequency in the quasi-TM mode is changed with the dielectric constant of the dielectric core 3, as shown in Table 1.The change amount can be absorbed in the following step 3.

(Step 3)

The resonance frequency in the quasi-TEM mode is determined eventually by the linear expansion coefficient of the conductor rod 4. Thus, a linear expansion coefficient of the conductor rod 4 is determined such that the resonance frequency in the quasi-TEM mode becomes substantially constant. In particular, as seen in FIG. 32, as material for the conductor rod 4, a material is selected having a linear expansion coefficient at which the resonance frequency in the quasi-TEM mode becomes substantially constant for changes in temperature. FIG. 33C shows the temperature characteristic.

In the above-described example, first, the temperature compensation of the quasi-TEM mode is carried out. Next, the temperature compensation of the quasi-TEM mode is conducted. However, first, the temperature compensation of the quasi-TEM mode may be made, followed by that of the quasi-TM mode, since the change of the resonance frequency in the quasi-TEM mode with temperature, based on the change of the dielectric constant of the dielectric core 3, is small.

Figure 34A:
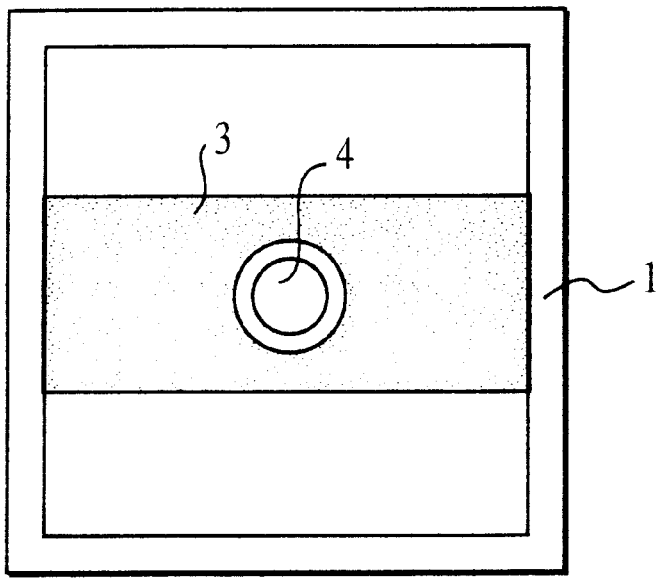
FIGS. 34A and 34B show the configuration of a resonator device according to a thirteenth embodiment of the present invention.
Figure 34B:
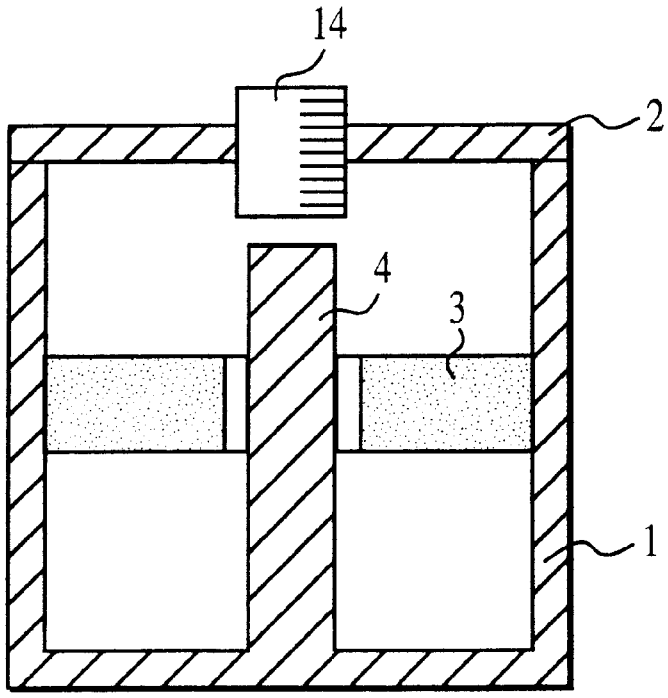

Next, the structure of a resonator device of the thirteenth embodiment will be described with reference to FIGS. 34A and 34B. The fundamental whole structure of this resonator device is the same as that of the first embodiment shown in FIGS. 1 to 3A and 3B. FIG. 34A is a plan view of the resonator device prior to the attachment of the cavity lid 2. FIG. 34B is a center longitudinal cross section of the resonator device having the cavity lid 2 attached thereto. The resonator device differs from that of the first embodiment in that the cavity lid 2 is provided with a frequency adjustment screw 14 for adjusting the resonance frequency in the quasi-TEM mode. With the frequency adjustment screw 14, the static capacitance produced between the screw 14 and the top of the conductor rod 4 is controlled by adjusting the projection degree of the frequency adjustment screw 14 projected into the cavity body 1. The resonance frequency in the quasi-TEM mode is controlled by the adjustment of this static capacitance.

In this case, the cavity body 1 is produced by molding aluminum, and forming an Ag plating film on the outer surface of the aluminum molded product. As the conductor rod 4, a round rod made of iron is used, and the frequency adjustment screw 14 is formed from brass. In the structure in which the frequency adjustment screw 14 is provided as described above, the temperature characteristic of the quasi-TEM mode is changed, depending on the projection degrees of the conductor rod 4 and the frequency adjustment screw 14 and the linear expansion coefficients of them. In particular, in FIGS. 34A and 34B, both of the conductor rod 4 and the frequency adjustment screw 14 as a whole function as a center conductor in the quasi-TEM mode. Accordingly, the combined linear expansion coefficient is determined by the linear expansion coefficients of the conductor rod 4 and the frequency adjustment screw 14, and the lengths of the parts of the conductor rod and the screw in the longitudinal direction of the cavity. Accordingly, in the design of the resonator device, materials for the conductor rod 4 and the frequency adjustment screw 14 and the lengths thereof are determined so that the change of the resonance frequency in the quasi-TEM mode with temperature can be stabilized.

As seen in the above-description, in the case in which the frequency adjustment screw 14 is provided, the material for the conductor rod in the preferable form of the present invention means the material for each of the conductor rod 4 and the frequency adjustment screw 14, shown in FIGS. 34A and 34B.

In this embodiment, for the dielectric core 3, the material is selected of which the temperature coefficient τf of the dielectric constant is −15 (ppm/°C.) so that the resonance frequency in the quasi-TM mode is substantially constant for changes in temperature. As material having the above-mentioned characteristic, a dielectric ceramic of (Zr, Sn) $TiO_2$ may be employed.

Figure 27:
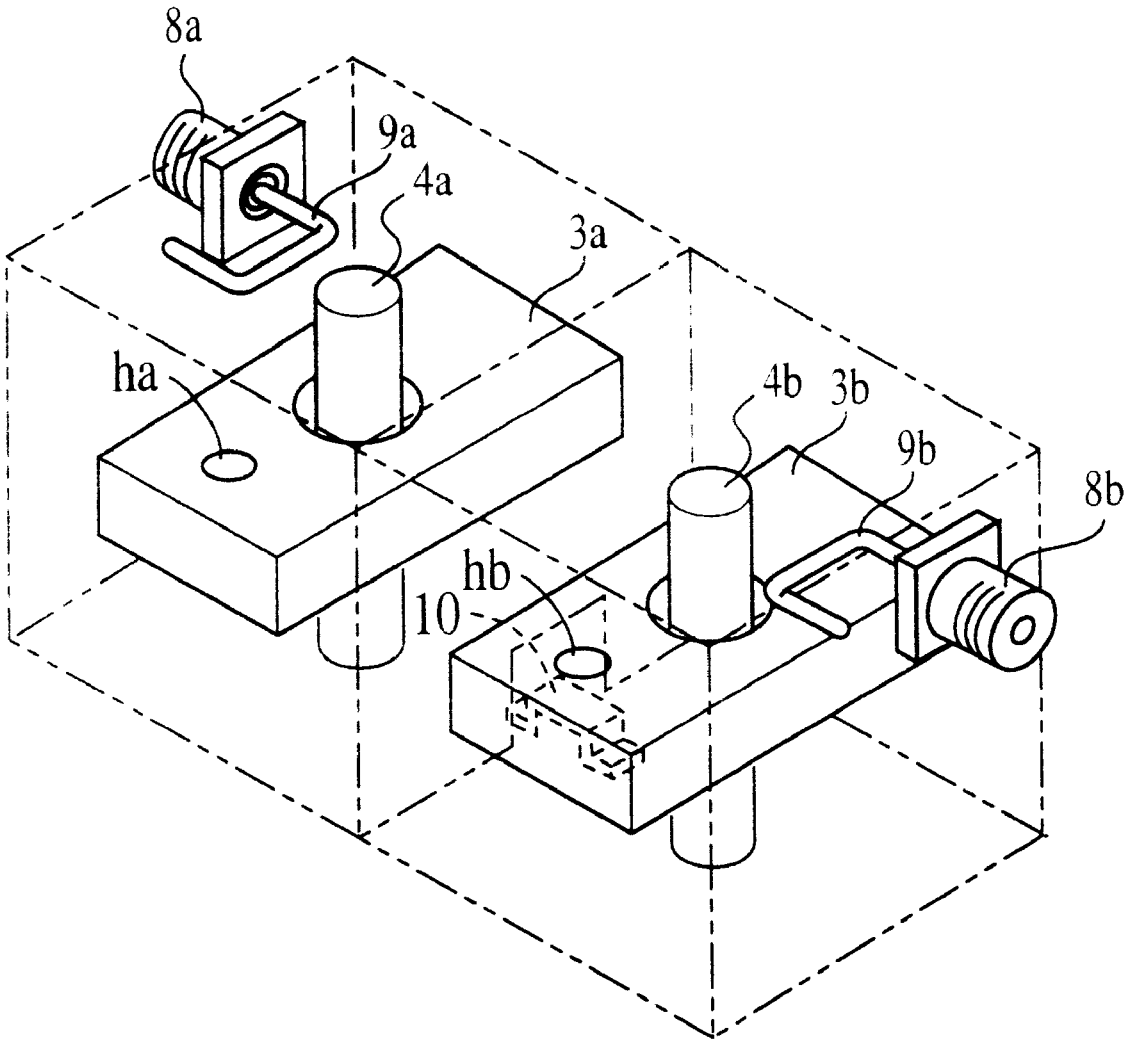
FIG. 27 shows the configuration of a filter according to a fourteenth embodiment of the present invention.

Hereinafter, a filter according to a fourteenth embodiment of the present invention will be described with reference to FIG. 27. In FIG. 27, the cavities are shown by alternate long and two short dash lines. The tops of conductor rods 4*a* and 4*b* are spaced from the inner walls of the cavities. With this structure, this device functions as a resonator operating in a quasi-TEM mode produced by the conductor rod 4*a* and the cavity surrounding the conductor rod 4*a,* and moreover, functions as a resonator operating in a quasi-TM mode produced by a dielectric core 3*a* and the cavity surrounding the conductor rod 3*a*. Similarly, this device functions as a resonator operating in a quasi-TEM mode produced by the conductor rod 4*b* and the cavity surrounding the conductor rod 4*b,* and moreover, functions as a resonator operating in a quasi-TM mode produced by a dielectric core 3*b* and the cavity surrounding the dielectric core 3*b*. Coaxial connectors 8*a* and 8*b* are provided, and the center conductors of the connectors 8*a* and 8*b* and the inner surfaces of the cavity are connected through coupling loop 9*a* and 9*b,* respectively. The coupling loops 9*a* and 9*b* are arranged in such a manner that the loop planes thereof link with magnetic fields in the above-described quasi-TM mode are linked together, and don't substantially link with magnetic fields in the quasi-TEM mode, respectively. Thus, these coupling loops 9*a* and 9*b* are coupled with the magnetic fields in the above-described quasi-TM mode.

Coupling adjustment holes ha and hb, each of which correspond to the hole h in the first embodiment, shown in FIG. 4, are provided to couple the quasi-TM and quasi-TEM modes to each other. Moreover, a window is formed in the wall between the two adjacent cavities. A coupling loop 10 is disposed so as to extend through the window. The loop plane of the coupling loop 10 is directed in such a manner that the magnetic fields in the quasi-TM mode don't link with each other, and the magnetic fields in the quasi-TEM mode link with each other. Thus, the coupling loop 10 links with the magnetic fields in the quasi-TEM mode, produced in the two cavities. Accordingly, the quasi-TM mode, the quasi-TEM mode, the quasi-TEM mode, and the quasi-TM mode are coupled sequentially in that order, in the range from the coaxial connector 8*a* to the coaxial connector 8*b*. As a whole, this device functions as a filter comprising four resonator stages, having a band-pass characteristic.

Hereinafter, another filter according to a fifteenth embodiment of the present invention will be described with reference to FIGS. 28A and 28B.

Figure 28A:
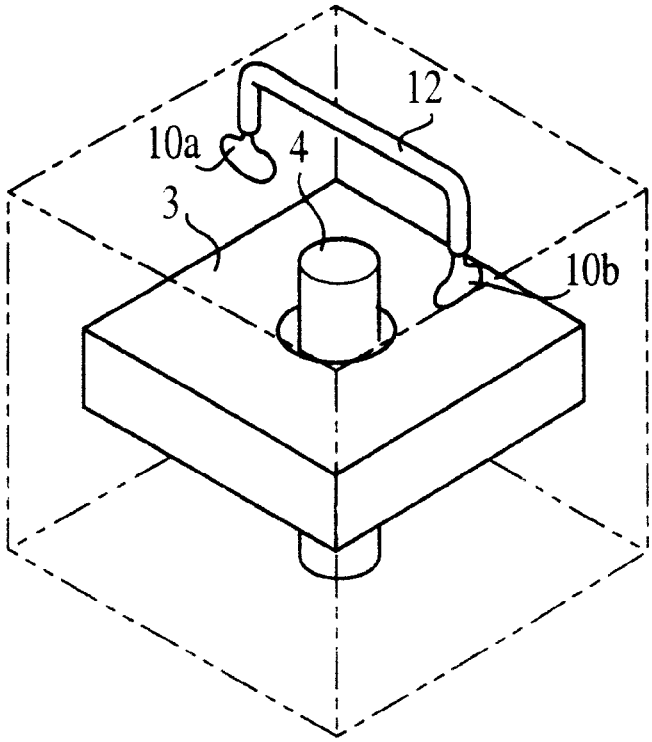
FIG. 28 shows the configuration of a filter according to a fifteenth embodiment of the present invention.
Figure 28B:
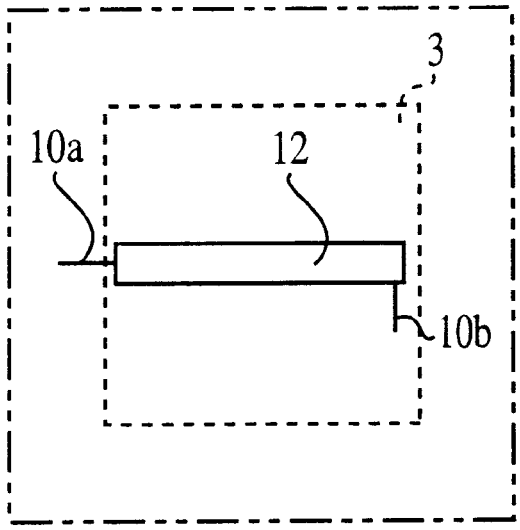

FIG. 28A is a perspective view of the filter, and FIG. 28B is a plan view thereof. The cavity is shown by an alternate long and two short dash line. In the cavity, the dielectric core 3 and the conductor rod 4 inserted in and through a hole formed in the center of the dielectric core 3 are provided. With this structure, the resonator in the quasi-TEM mode caused by the cavity and the conductor rod 4 and the resonator in the quasi-TE mode caused by the dielectric core 3 are multiplexed. Two coupling loops 10*a* and 10*b* are provided in the cavity, and moreover, and are connected through a cable 12 having an electrical length of one-quarter wavelength. The coupling loop 10*a* is directed in such a manner that it links with the magnetic field in the quasi-TEM mode, and doesn't link with the magnetic field in the quasi-TE mode. On the other hand, the coupling loop 10*b* is directed in such a manner that it links with the magnetic field in the quasi-TE mode, and doesn't link with magnetic field in the quasi-TEM mode. Thus, the resonator in the quasi-TEM mode and the resonator in the quasi-TE mode are coupled through the cable 12 having a one-quarter wavelength. When this filter is used as a band-elimination filter, another coupling loop for coupling the magnetic fields in the quasi-TEM and quasi-TE modes is provided. The filter comprising the two resonator stages is connected between a transmission line and the ground.

Figure 29:
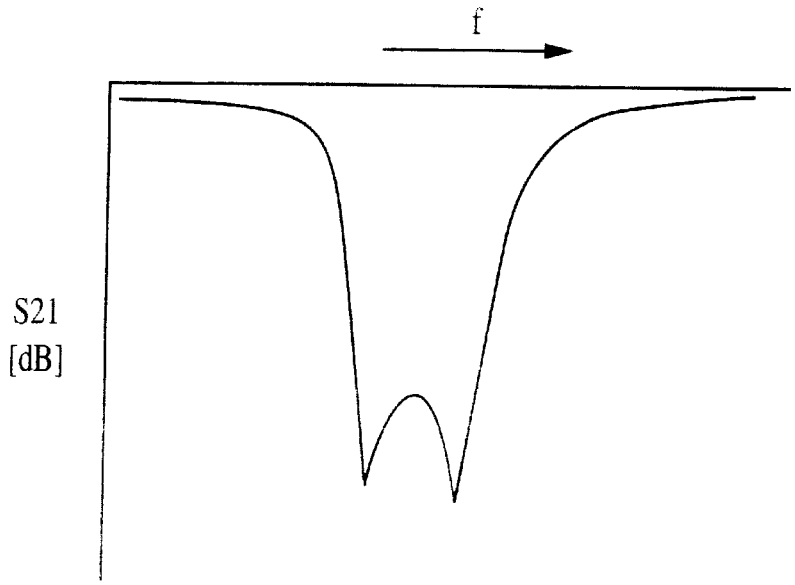
FIG. 29 is a graph showing the transmission characteristic of the filter.

FIG. 29 is a graph showing the transmission characteristic of the above-described filter. As seen in the graph, a band-elimination filter characteristic can be obtained, in which the resonance frequencies of the two stage resonators are attenuated.

Figure 30:
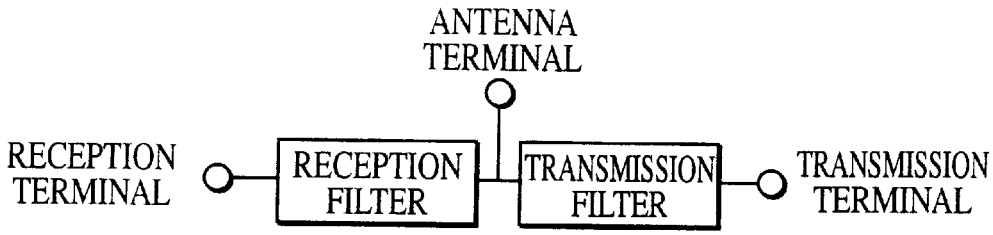
FIG. 30 is a diagram showing the configuration of a duplexer according to a sixteenth embodiment of the present invention.

FIG. 30 shows an example of the configuration of a transmission/reception sharing device. In this case, the transmission filter and the reception filter are band-pass filters each having the same configuration as the above-described dielectric filter. The transmission filter allows a transmission frequency signal to pass, and the reception filter allows a reception frequency signal to pass. The position at which the output port of the transmission filter and the input port of the reception filter are connected to each other is set in such a manner that the electrical length from the connection point to the equivalent short-circuiting plane of the final stage resonator of the transmission filter is an odd number times one-quarter wavelength at the frequency of a transmission signal, and also, the electrical length from the connection point to the equivalent short-circuiting plane of the initial stage resonator of the reception filter is an odd number times one-quarter wavelength at the frequency of a reception signal. This causes the transmission and reception signals to be securely branched.

Similarly, a diplexer and a multiplexer can be formed by providing plural dielectric filters between the common port and the individual ports, as described above.

Figure 31:
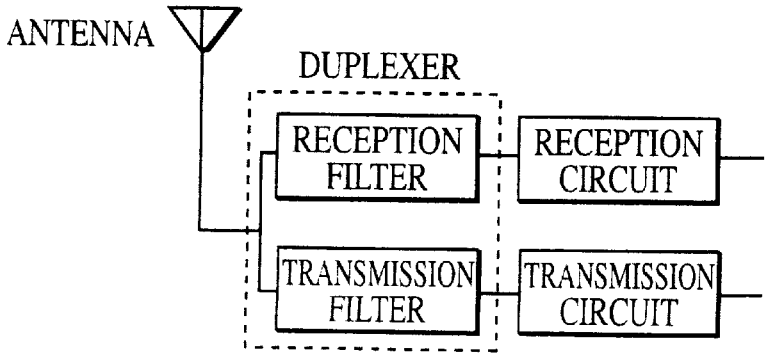
FIG. 31 is a diagram showing the configuration of a communication device according to a seventeenth embodiment of the present invention.

FIG. 31 is a block diagram showing the configuration of a communication device including the above-described transmission reception sharing device (duplexer). As seen in FIG. 31, a transmission circuit is connected to the input port of the transmission filer, a reception circuit is connected to the output port of the reception filter, and an antenna is connected to the input-output port of the duplexer. Thus, a high frequency section of the communication device is formed.

In addition, by forming circuit elements such as the above diplexer, a multiplexer, a synthesizer, a distributor, and so forth from the above-described dielectric resonator device, respectively, and forming a communication device by using these circuit elements, the communication device can be reduced in size.

According to the present invention, the resonators can be multiplexed in one cavity. The overall configuration of a resonator device having a predetermined number of stages can be reduced in size.

Moreover, the dielectric core can be disposed at an optional position, e.g., in the center of the cavity.

Furthermore, the capacitance component which determines the resonance frequency in the resonance mode, caused by the cavity and the dielectric core, can be increased. Accordingly, the resonator can be miniaturized by reducing the size of the cavity.

The capacitance component which determines the resonance frequency in the resonance mode, caused by the cavity and the dielectric core, can be decreased. Accordingly, the size of the cavity can be increased to some degree, so that the Q value of the resonator is enhanced.

Three resonators can be formed in one cavity. Further miniaturization is possible.

The temperature characteristics in the resonance modes caused by the cavity and the dielectric core and by the conductor rod and the cavity can be easily stabilized.

The filter, the composite filter device, and the duplexer each comprising multi-stage resonators can be easily formed.

A communication device having a small overall size, a low loss, and a high gain can be easily formed by use of the resonators which are small in size and have a high Q value.

Although the present invention has been described in relation to particular embodiments thereof, many other variations and modifications and other uses will become apparent to those skilled in the art. Therefore, the present invention is not limited by the specific disclosure herein.

What is claimed is:

1. A resonator device comprising a conductive rod provided in a conductive cavity with at least one end of the rod being electrically connected to the cavity, and a dielectric core having a hole provided in the cavity, wherein a resonance frequency in a resonance mode determined by the cavity and the rod and a resonance frequency in a resonance mode determined by the cavity and the dielectric core are set substantially equal to each other and wherein the rod extends through the hole.

2. A resonator device according to claim 1, wherein the dielectric core is bonded to the inner surface of the cavity.

3. A resonator device according to claim 1, wherein the dielectric core is supported on a stand in the cavity, and the dielectric core is spaced from the inner surface of the cavity.

4. A resonator device according to claim 1, wherein the dielectric core has at least one coupling adjustment hole in addition to the hole through which the rod extends.

5. A resonator device according to claim 1, wherein the dielectric core has a surface bonded to the inner surface of the cavity.

6. A resonator device according to claim 1, wherein the rod has a square-cross section.

7. A resonator device according to any one of claims 1 to 3, wherein the resonance mode determined by the cavity and the rod is a quasi-TEM mode, the resonance mode determined by the cavity and the dielectric core is a quasi-TM mode, and the two resonance modes are duplex modes.

8. A resonator device according to any one of claims 1 to 3, wherein the resonance mode determined by the cavity and the rod is a quasi-TEM mode, the resonance mode determined by the cavity and the dielectric core is a quasi-TE mode, and the two resonance modes are duplex modes.

9. A resonator according to any one of claims 1 to 3, wherein the resonance mode determined by the cavity and the rod is a quasi-TEM mode, the resonance mode determined by the cavity and the dielectric core is a duplex quasi-TM mode, whereby said resonance modes are triplex modes.

10. A resonator device according to claim 1, wherein the dielectric core has a polyhedron shape.

11. A resonator device according to claim 1, wherein the dielectric core has a columnar shape.

12. A resonator device according to claim 1, wherein the rod has a circular-cross section.

13. A filter comprising:

a resonator device comprising a conductive rod provided in a conductive cavity with at least one end of the rod being electrically connected to the cavity, and a dielectric core having a hole provided in the cavity, wherein a resonance frequency in a resonance mode determined by the cavity and the rod and a resonance frequency in a resonance mode determined by the cavity and the dielectric core are set substantially equal to each other and wherein the rod extends through the hole;

an input-output conductor which is coupled to a predetermined mode of said resonance modes and is thereby operable to carry out input-output of a signal to and from said resonator device.

14. A communication device comprising:

a transmission circuit;

a reception circuit; and a filter connected to at least one of said transmission circuit and said reception circuit, said filter comprising:

a resonator device comprising a conductive rod provided in a conductive cavity with at least one end of the rod being electrically connected to the cavity, and a dielectric core having a hole provided in the cavity, wherein a resonance frequency in a resonance mode determined by the cavity and the rod and a resonance frequency in a resonance mode determined by the cavity and the dielectric core are set substantially equal to each other and wherein the rod extends through the hole; and an input-output conductor which is coupled to a predetermined mode of said resonance modes and is thereby operable to carry out input-output of a signal to and from said resonator device.

15. A communication device comprising:

a transmission circuit;

a reception circuit; and a composite filter device connected to at least one of said transmission circuit and said reception circuit, said composite filter device comprising:

a resonator device comprising a conductive rod provided in a conductive cavity with at least one end of the rod being electrically connected to the cavity, and a dielectric core having a hole provided in the cavity, wherein a resonance frequency in a resonance mode determined by the cavity and the rod and a resonance frequency in a resonance mode determined by the cavity and the dielectric core are set substantially equal to each other and wherein the rod extends through the hole; and an input-output conductor which is coupled to a predetermined mode of said resonance modes and is thereby operable to carry out input-output of a signal to and from said resonator device.

16. A communication device comprising:

a transmission circuit;

a reception circuit; and a duplexer connected to said transmission circuit and said reception circuit, said duplexer comprising:

first and second filters, each of said filters comprising:

a resonator device comprising a conductive rod provided in a conductive cavity with at least one end of the rod being electrically connected to the cavity, and a dielectric core having a hole provided in the cavity, wherein a resonance frequency in a resonance mode determined by the cavity and the rod and a resonance frequency in a resonance mode determined by the cavity and the dielectric core are set substantially equal to each other and wherein the rod extends through the hole; and at least one input-output conductor which is coupled to a predetermined mode of said resonance modes and is thereby operable to carry out input-output of a signal to and from said resonator device;

each said filter having an input port and an output port, each being connected to a respective input-output conductor of said filter;

the input port of the first filter being a transmission input port for inputting a transmission signal, the output port of the second filter being a reception output port for outputting a reception signal, the output port of the first filter being connected to the input port of the second filter for providing an antenna port;

said transmission circuit being connected to said transmission input port, and said reception circuit being connected to said reception output port.

17. The communication device of claim 16, further comprising an antenna connected to said antenna port.

18. A composite filter device comprising a plurality of filters, each said filter comprising:

a resonator device comprising a conductive rod provided in a conductive cavity with at least one end of the rod being electrically connected to the cavity, and a dielectric core having a hole provided in the cavity, wherein a resonance frequency in a resonance mode determined by the cavity and the rod and a resonance frequency in a resonance mode determined by the cavity and the dielectric core are set substantially equal to each other and wherein the rod extends through the hole; and an input-output conductor which is coupled to a predetermined mode of said resonance modes and is thereby operable to carry out input-output of a signal to and from said resonator device.

19. A composite filter device according to claim 18, wherein said plurality of filters comprises first and second filters for providing a duplexer, each of said filters comprising:

a resonator device comprising a conductive rod provided in a conductive cavity with at least one end of the rod being electrically connected to the cavity, and a dielectric core having a hole provided in the cavity, wherein a resonance frequency in a resonance mode determined by the cavity and the rod and a resonance frequency in a resonance mode determined by the cavity and the dielectric core are set substantially equal to each other and wherein the rod extends through the hole; and at least one input-output conductor which is coupled to a predetermined mode of said resonance modes and is thereby operable to carry out input-output of a signal to and from said resonator device;

each said filter having an input port and an output port, each being connected to a respective input-output conductor of said filter;

the input port of the first filter being a transmission input port for inputting a transmission signal, the output port of the second filter being a reception output port for outputting a reception signal, the output port of the first filter being connected to the input port of the second filter for providing an antenna port.

20. A method of producing a resonator device comprising a conductive rod provided in a conductive cavity with at least one end of the rod being electrically connected to the cavity, and a dielectric core having a hole provided in the cavity, wherein a resonance frequency in a resonance mode determined by the cavity and the rod and a resonance frequency in a resonance mode determined by the cavity and the dielectric core are set substantially equal to each other and wherein the rod extends through the hole; said method comprising the steps of:

selecting a material for the dielectric core such that a change of the resonance frequency in the resonance mode determined by the cavity and the dielectric core is substantially constant for changes in temperature, selecting a material for the rod such that a change of the resonance frequency in the resonance mode determined by the cavity and the rod is substantially constant for changes in temperature, and assembling said resonator device with the selected materials.

* * * * *